US010524595B2

(12) United States Patent
Rager

(10) Patent No.: US 10,524,595 B2
(45) Date of Patent: Jan. 7, 2020

(54) SLEEP SYSTEM

(71) Applicant: David Rager, Blanco, TX (US)

(72) Inventor: David Rager, Blanco, TX (US)

( * ) Notice: Subject to any disclaimer, the term of this patent is extended or adjusted under 35 U.S.C. 154(b) by 0 days.

(21) Appl. No.: 15/396,375

(22) Filed: Dec. 30, 2016

(65) Prior Publication Data

US 2018/0184821 A1 Jul. 5, 2018

(51) Int. Cl.
*A47G 9/10* (2006.01)

(52) U.S. Cl.
CPC ..... *A47G 9/1009* (2013.01)

(58) Field of Classification Search
CPC ..... A47G 9/10
USPC ..... 5/636, 640, 643
See application file for complete search history.

(56) References Cited

U.S. PATENT DOCUMENTS

| | | | | |
|---|---|---|---|---|
| 490,865 | A | 1/1893 | Dreisbach | |
| 926,563 | A | 6/1909 | Hobson | |
| 1,098,236 | A | 5/1914 | Duckworth | |
| 1,163,945 | A | 12/1915 | Murdock | |
| 1,469,082 | A | 9/1923 | Hall | |
| 1,921,984 | A | 8/1933 | Moore | |
| 2,056,479 | A | 10/1936 | Newman | |
| 2,551,727 | A | 5/1951 | Costello | |
| 2,581,802 | A * | 1/1952 | Lyons | A47G 9/1009 297/313 |
| 2,634,435 | A * | 4/1953 | Leighton | A47G 9/1009 132/333 |
| 2,695,415 | A | 11/1954 | Holton | |
| 3,114,527 | A | 12/1963 | Demarest | |
| 4,823,776 | A | 4/1989 | Foster | |
| 5,033,138 | A | 7/1991 | Hong | |
| 5,337,429 | A | 8/1994 | Tucker | |
| 5,353,457 | A | 10/1994 | Chu | |
| 5,467,490 | A | 11/1995 | Rice | |
| 6,234,435 | B1 * | 5/2001 | Yeh | A45D 42/14 248/205.5 |

(Continued)

FOREIGN PATENT DOCUMENTS

| | | | |
|---|---|---|---|
| WO | 2002067729 | A2 | 6/2002 |
| WO | 2002067729 | A2 | 9/2002 |

(Continued)

OTHER PUBLICATIONS

COUNTOUR—"Body Wedge Helps Reduce Night-Time Acid Reflux", downloaded from www.contourliving.com on Nov. 28, 2016 (pp. 1-7).

(Continued)

*Primary Examiner* — Fredrick C Conley
(74) *Attorney, Agent, or Firm* — Mark P Kahler

(57) ABSTRACT

A sleep system includes a pair of riser members spaced apart by a predetermined distance. A rigid connective member between the riser members may provide this spacing. A flexible sheet extends between the riser members and may be secured to the riser members by respective clamps that hold the ends of the sheet to the respective riser members. A flexible load-bearing member, such as a sleeve that encloses one or more cushion elements, may be situated atop the flexible sheet to provide support to the user's head and neck at a height selectable by the user adjusting one of, or both of, the clamps on the riser members.

22 Claims, 19 Drawing Sheets

(56) References Cited

U.S. PATENT DOCUMENTS

| | | | | |
|---|---|---|---|---|
| 6,581,226 | B1 * | 6/2003 | Brustein | A47G 9/1009 5/636 |
| 8,220,091 | B2 | 7/2012 | Shultz | |
| 2004/0128769 | A1 | 7/2004 | Azoulay | |
| 2009/0113634 | A1 | 5/2009 | Macedo | |
| 2013/0047338 | A1 | 2/2013 | Lin | |
| 2016/0066697 | A1 | 3/2016 | Adams | |

FOREIGN PATENT DOCUMENTS

| | | | |
|---|---|---|---|
| WO | 2006078146 | A1 | 7/2006 |
| WO | 2015005666 | A1 | 1/2015 |

OTHER PUBLICATIONS

GRASYTE—"Someone Finally Invented a Head Hammock So You Could Fall Asleep on a Plane", downloaded from www.boredpanda.com on Dec. 11, 2016 (pp. 1-3).
TRTL—"Trtl Travel Pillow, The Travel Pillow. Reinvented", downloaded from www.trtltravel.com on Dec. 3, 2016 (pp. 1-13).

* cited by examiner

SLEEP SYSTEM

BACKGROUND

The disclosures herein relate generally to devices for aiding human sleep, and more particularly, to sleep systems that provide improved support for the human head and neck to promote better sleep.

BRIEF SUMMARY

In one embodiment, a sleep system is disclosed that includes a first support component including a first riser member attached to a first base. The sleep system also includes a second support component including a second riser member attached to a second base. The sleep system may also include a rigid connective member positioned between the first and second support components to rigidly hold the first and second riser members at a predetermined distance apart from one another. The sleep system may further include a flexible sheet extending between the first and second riser members. The sleep system may still further include a flexible load-bearing member, situated atop the flexible sheet and including first and second ends, wherein the flexible load-bearing member is provided support by the flexible sheet between the first and second riser members. First and second clamps may be employed on the first and second riser members to hold respective locations on the flexible sheet to the first and second riser members, to provide support to the flexible sheet and the flexible load-bearing member atop the flexible sheet.

In another embodiment, a sleep system is disclosed that includes a first support component including a first riser member attached to a first base. The sleep system also includes a second support component including a second riser member attached to a second base. The sleep system also includes a rigid connective member positioned between the first and second support components to rigidly hold the first and second riser members at a predetermined distance apart from one another. The sleep system further includes a flexible load-bearing member, situated between the first and second riser members, the flexible load-bearing member including first and second ends. The sleep system further includes a first flexible sheet attached to the first end of the flexible load-bearing member. The sleep system still further includes a second flexible sheet attached to the second end of the flexible load-bearing member. In this embodiment, the flexible load-bearing member is provided support between the first and second riser members by attachment of the first flexible sheet to the first riser member, and by attachment of the second flexible sheet to the second riser member. First and second clamps may be used on the first and second riser members to achieve these attachments, respectively.

BRIEF DESCRIPTION OF THE DRAWINGS

The appended drawings illustrate only exemplary embodiments of the invention and therefore do not limit its scope because the inventive concepts lend themselves to other equally effective embodiments.

DETAILED DESCRIPTION

A sleep system is disclosed that addresses the problems experienced by numerous users of head supports such as pillows. Many pillows employ a "one height fits all" approach. While some pillows may start with the user's head in a desirable position above a mattress, as time passes by during a sleep session the cushioning material inside the pillow often compresses. This compression reduces the height of the head above the mattress from its initial starting position and frequently renders the pillow uncomfortable to the user. One embodiment of the disclosed sleep system allows the user to select a desirable head and neck height elevation that persists throughout the sleep session. The sleep system may include a user-customized head and neck height reference as well providing a user-adjustable head, neck and face support.

Figure 1:
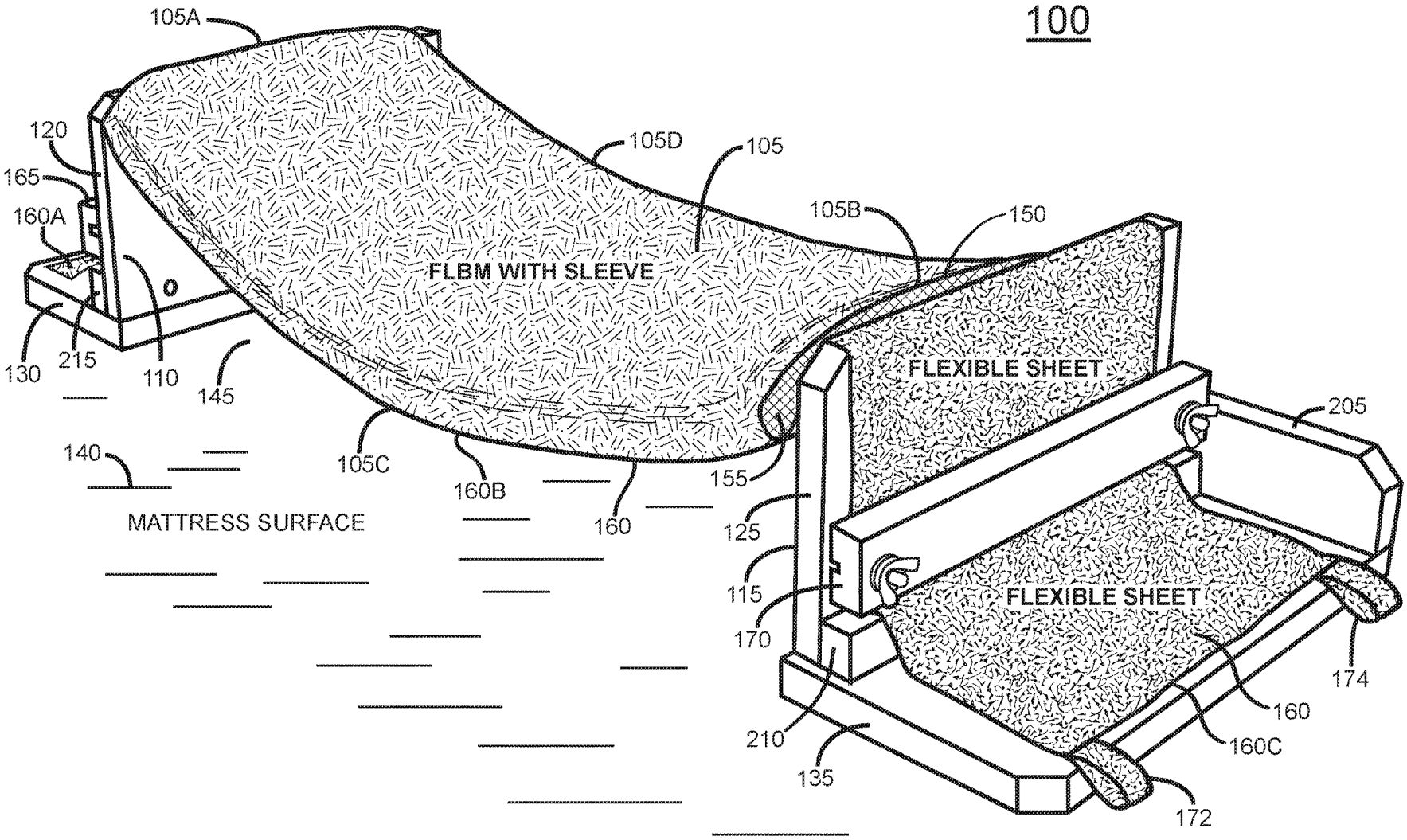
FIG. 1 is a perspective view of one embodiment of the disclosed sleep system.

FIG. 1 shows one embodiment of sleep system 100. Sleep system 100 includes a flexible load-bearing member (FLBM) 105 that is supported at its opposed ends 105A and 105B by support components 110 and 115, respectively. Flexible load-bearing member 105 is configured to support the weight of the user's head and neck. Flexible load-bearing member 105 may include cushioning for the comfort on the user. As seen in FIG. 1, and as shown more clearly in FIG. 2, support components 110 and 115 include riser members 120 and 125 that are fixedly mounted to bases 130 and 135, respectively. Bases 130 and 135 rest on a sleep surface such as mattress 140. An open region 145 is formed between the bottom of flexible load-bearing member (FLBM) 105 and mattress surface 140 below. As viewed in FIG. 1, flexible load-bearing member 105 includes a front side 105C and a rear side 105D. Front side 105C faces the user's body as described in more detail below. Rear side 105D typically faces the rearmost side (not shown) of mattress 140.

Figure 2:
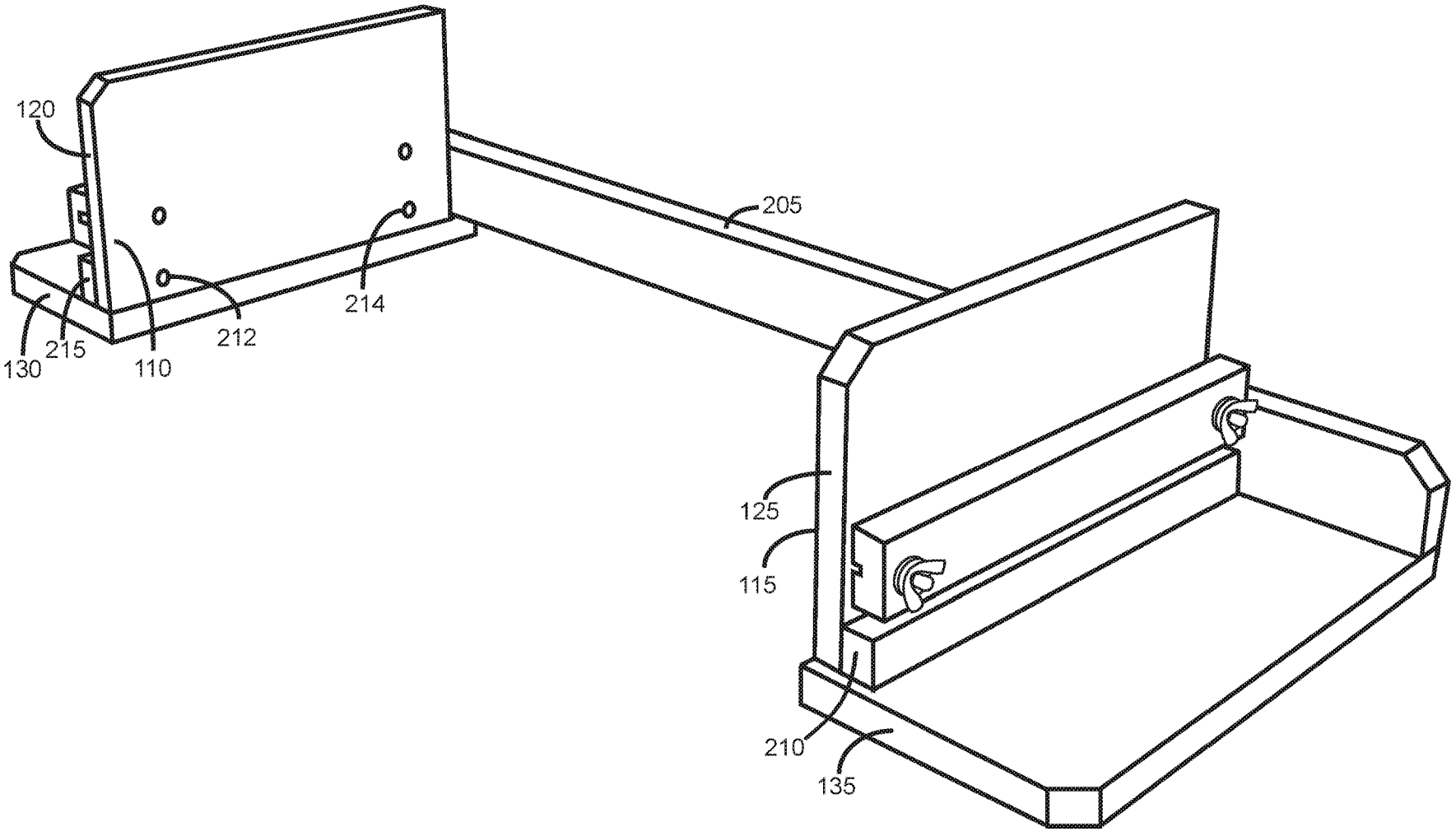
FIG. 2 is a front right perspective view of one embodiment of the disclosed sleep system prior to installation of the flexible load-bearing member.

In one embodiment, a connective member 205 acts as a cross member that connects support components 110 and 115 together and holds support components 110 and 115 a predetermined fixed distance apart from one another, as shown in FIG. 2. Cross member 205 may be a strut in one embodiment as illustrated. The distance between support components 110 and 115 is sufficiently large to accommodate flexible load-bearing member 105 therebetween as discussed in more detail below. In the embodiment shown, riser members 120 and 125 are vertical and perpendicularly-oriented with respect to bases 130 and 125, respectively.

Support component 115 includes a corner support bar 210 that is positioned at the location on base 135 where riser member 125 meets base 135. To hold riser member 125 in position, riser member 125 may be screwed or bolted to corner support bar 210, and in turn, corner support bar 210 may be screwed or bolted to base 135. Riser member 125 may also be screwed or bolted to base 135. Alternatively, or supplementally, riser member 125, corner support bar 210 and base 135 be glued together with adhesive. Likewise, support component 110 includes a corner support bar 215 that is positioned at the location on base 130 where riser member 120 meets base 130. To hold riser member 120 in position, riser member 120 may be screwed or bolted to corner support bar 215 via screws (or bolts) 212, 214, and in turn, corner support bar 215 may be screwed or bolted to base 130. Riser member 120 may also be screwed or bolted to base 130. Alternatively, or supplementally, riser member 120, corner support bar 215 and base 130 be glued together.

In one embodiment, a sleeve 150 or other cushion-containing member is situated atop a continuous flexible sheet 160. Sleeve 150 forms part of flexible load-bearing member (FLBM) 105. Sleeve 150 may hold one or more cushion elements such as 155 and 157 therein. Cushion elements with different cushion densities may be employed that are selectable by the user. At least one end of sleeve 150 is open to receive a cushion element 155 therein. Alternatively, both ends of sleeve 150 may be open to receive cushion element 155, or cushion elements 155, 157 therein from either end. In the embodiment depicted in FIG. 1, a continuous flexible sheet 160 of material extends from end-to-end of sleep system 100. More particularly, flexible sheet 160 includes an end 160A situated at base 130, a support section 160B that provides support to the flexible load-bearing member (FLBM) 105 between riser members 120 and 135, and further includes opposed end 160C at base 135, as shown. Flexible sheet 160 thus supports sleeve 150 that is located atop flexible sheet 160. It is noted that the multiple parallel dashed lines along FLBM front side 105C are used to indicate curvature of FLBM 105.

The riser members 120 and 125 of support components 110 and 115, respectively, are equipped with clamps 165 and 170, respectively, to hold flexible sheet 160 in position on riser members 120 and 125. In this manner, when the user rests his or her head on sleep system 100, flexible load-bearing member (FLBM) 105 remains in position and provides support to the user's head and neck.

In one embodiment, clamp 165 anchors flexible sheet 160 to riser member 120 near flexible sheet end 160A. Flexible sheet 160 extends from clamp 165 up to the top of riser member 120 and then spans the distance between riser member 120 and riser member 125. Flexible sheet 160 may be a continuous flexible sheet of supportive material. In this embodiment, the support section 160B of flexible sheet 160 is positioned at the bottom of flexible sheet and thus the entirety of support section 160B is not visible in FIG. 1. At riser member 125, flexible sheet 160 extends down to clamp 170 and is secured in position by tightening clamp 170. Flexible sheet 160 includes pull tabs 172 and 174 at end 160C so that the user may pull flexible sheet 160 through clamp 170 with ease before using clamp 170 to secure flexible sheet 160 in the desirable user-selected position. The operation of clamps 165 and 170 is described in more detail below.

In one embodiment, the user may lay their head directly on flexible load-bearing member 105 without using another cushion above FLBM 105. Clamps 165 and 170 of the disclosed sleep system 100 provide the user with a large amount of control over sleeping height above the mattress than achieved by conventional means. As seen in FIG. 1, a desirable open region 145 is created between the bottom side of FLBM 105 and mattress 140 below. As shown, FLBM 105 exhibits a shallow U-shaped geometry in lateral cross-section. A flatter FLBM geometry can be obtained by adding more tension to the FLBM by pulling more of the flexible sheet 170 of FLBM 105 through clamp 170 and then retightening the clamp. However, this might raise the user's head outside of the range of a person's ideal sleeping height above the mattress. In this scenario, it is necessary to lower the FLBM in reference to the mattress, and then add more tension via clamp 170.

FIG. 2 depicts one embodiment of the disclosed sleep system prior to installation of flexible load-bearing member (FLBM) 105 and flexible sheet 160 therein. This view shows connective member 205 extending between support components 110 and 115 together to provide a unitary structure that includes support components 110, 115 and connective member 205. In one embodiment, connective member 205 may be screwed to, bolted to, glued to or otherwise rigidly connected to support components 110 and 115 to hold the unitary structure thus formed rigidly together. In one embodiment, connective member 205 is configured to hold riser members 120 and 125 at a predetermined fixed distance apart such as approximately 60.96 cm (24 inches) apart. The fixed distance between riser members 120 and 125 may be selected within the range of approximately 50.8 cm (20 inches) to approximately 71.12 cm (28 inches), or an ever wider range, depending on the particular application.

Figure 3:
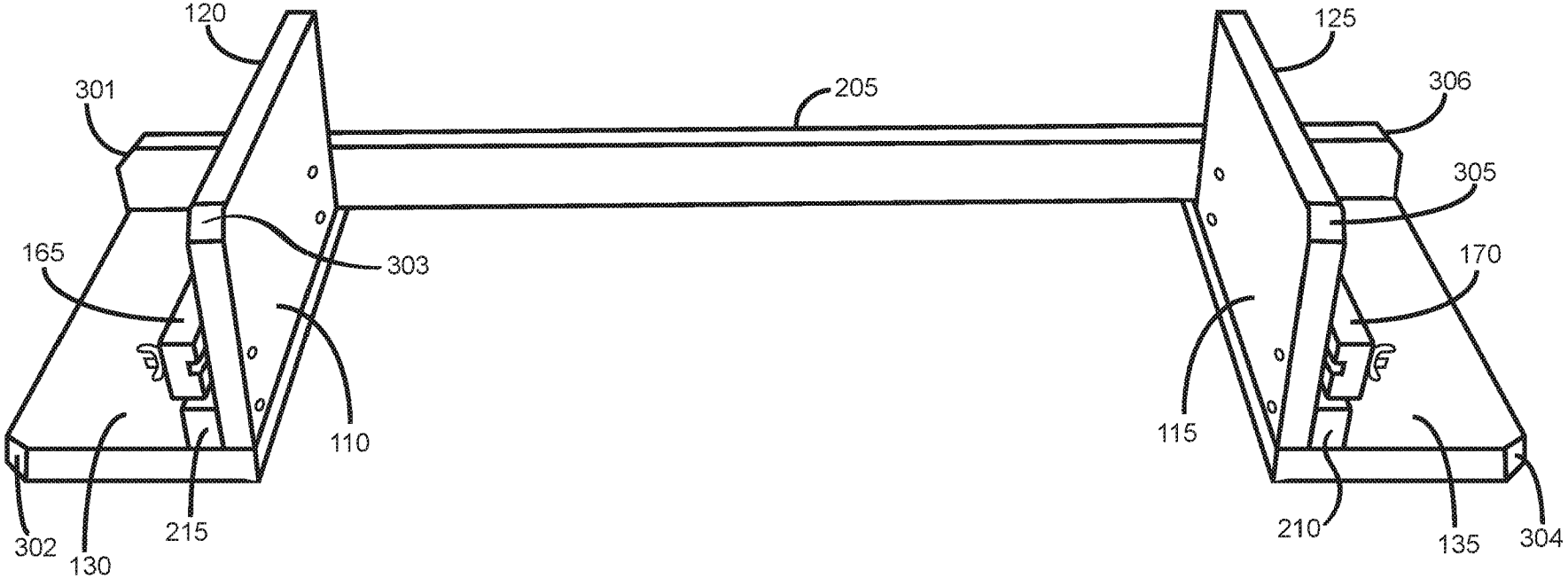
FIG. 3 is another front perspective view of the disclosed sleep system.
Figure 4:
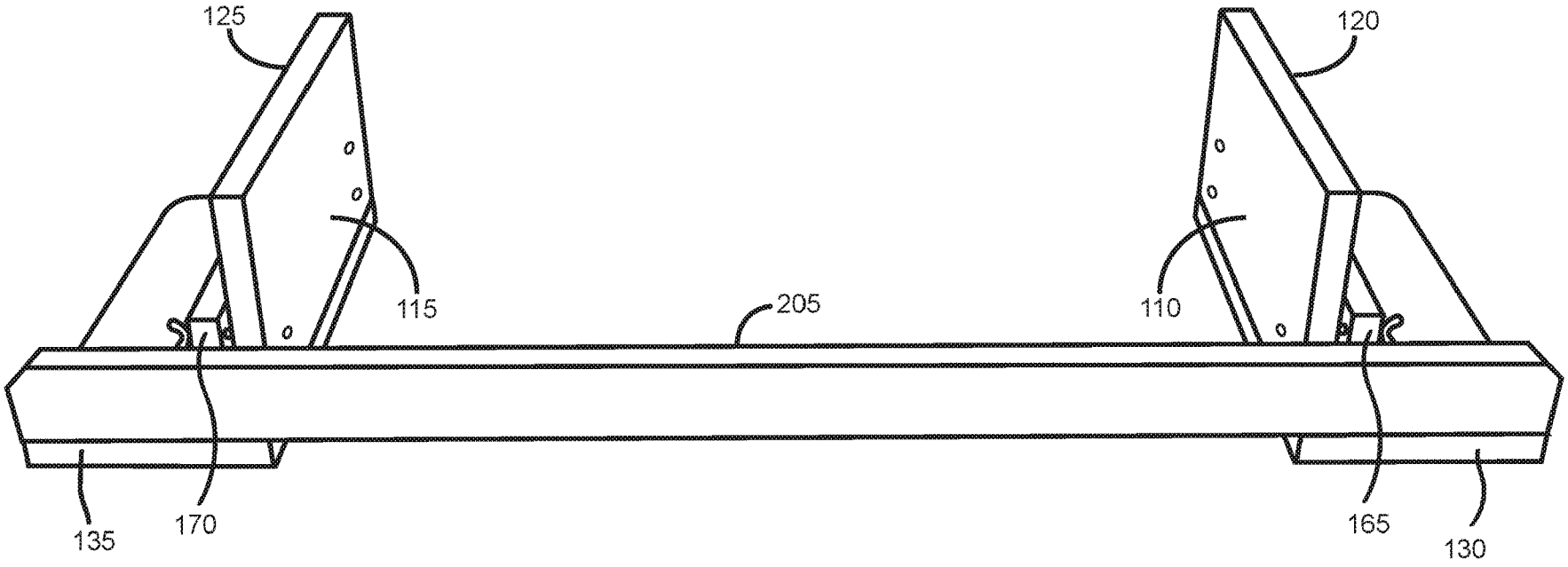
FIG. 4 is a rear perspective view of the disclosed sleep system.

FIG. 3 shows a front perspective view of the disclosed sleep system before installation of flexible load-bearing member (FLBM) 105 with flexible sheet 160 therein. The entire length of connective member 205 is shown between support components 110 and 115 in this view. FIG. 4 shows a rear perspective view of the disclosed sleep system before installation of flexible load-bearing member (FLBM) 105 and flexible sheet 160 therein. The entire length of connective member 205 is shown between support components 110 and 115 in the rear of the sleep system. As seen in FIG. 3, the sleep system includes beveled edges 301, 302, 303, 304, 305 and 306 to remove potentially sharp points that the user might otherwise contact.

Figure 5:
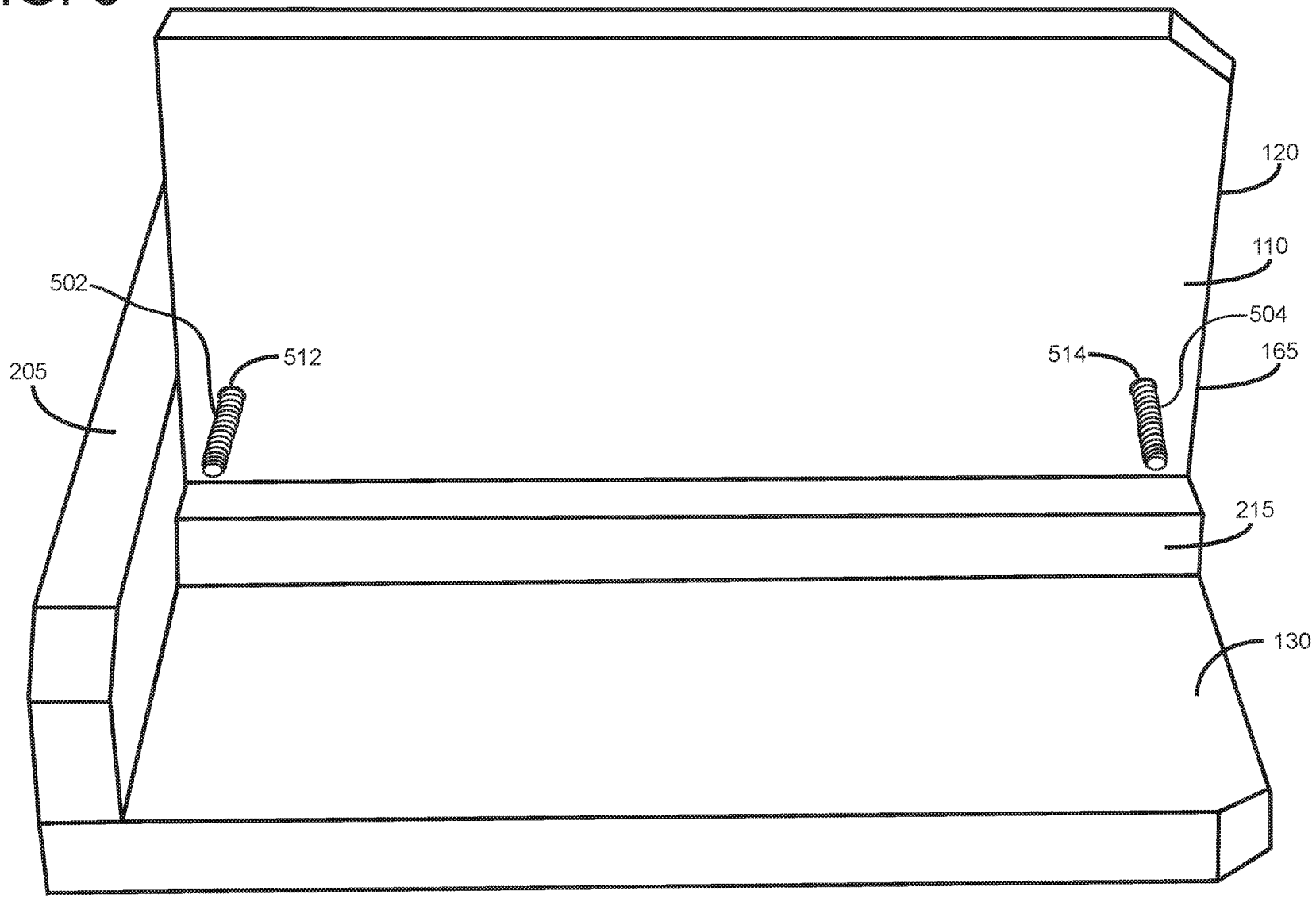
FIG. 5 is a left end perspective view of the riser member and base region of the disclosed sleep system prior to installation of the flexible sheet and flexible load-bearing member therein.

FIG. 5 is a left end perspective view of a portion of sleep system 100 prior to installation, by the user or other entity, of flexible load-bearing member (FLBM) 105 and flexible sheet 160 in the sleep system. The following components are visible in this view: base 130, riser member 120, and corner support bar 215, all of which when taken together form support component 110. A portion of connective member 205 is also visible. Bolts 502 and 504 are positioned in holes 512 and 514, respectively, of riser member 120. Bolts 502 and 504 are used to hold clamp bar 165 (not shown in this view) and flexible sheet 160 to riser member 120 as discussed below.

Figure 6:
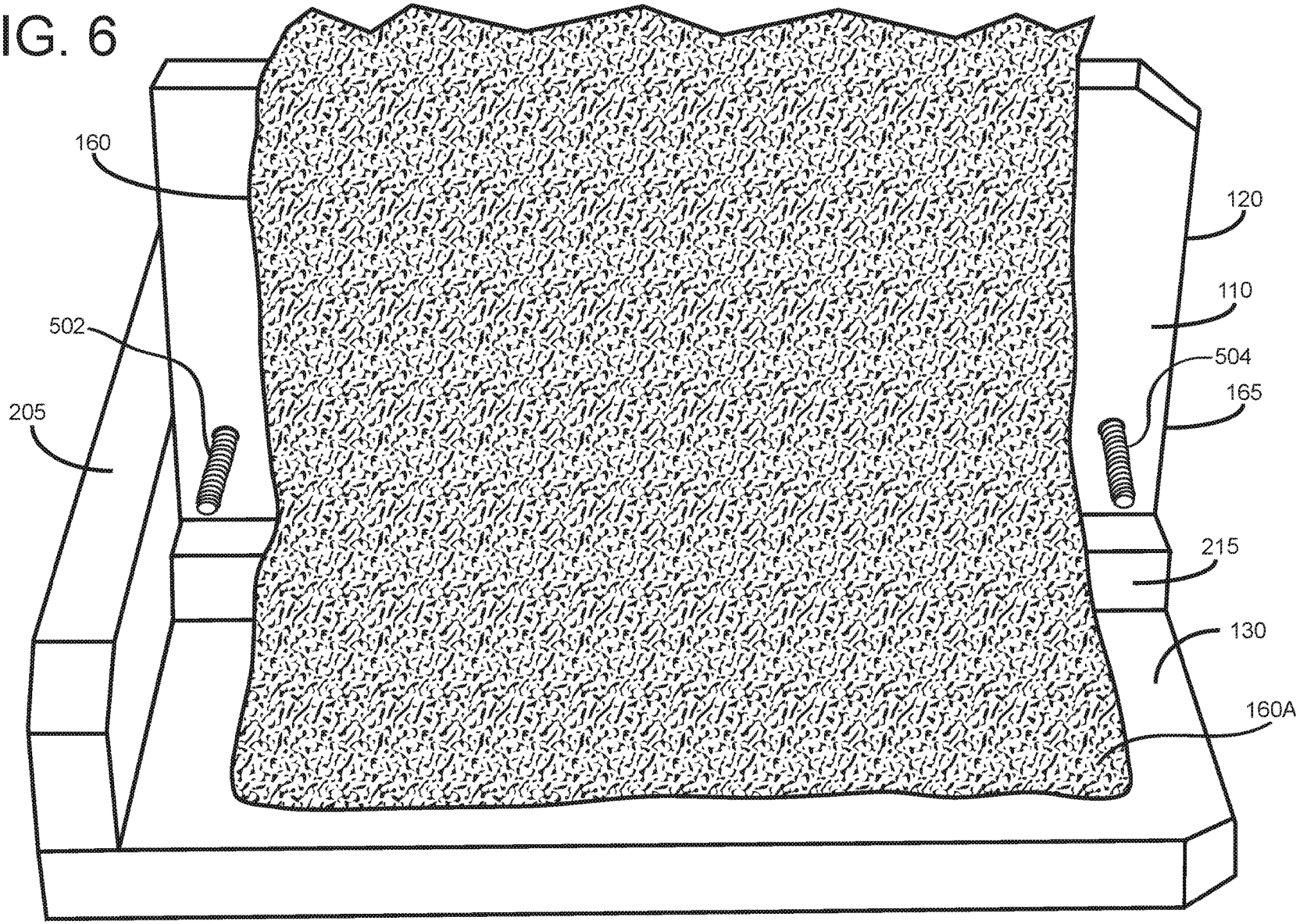
FIG. 6 is a left end perspective view of the riser member and base region of the disclosed sleep system prior during installation of the flexible member and flexible load-bearing system therein.

FIG. 6 is a left end perspective view of a portion of sleep system 100 showing installation by the user, or other entity, of flexible sheet 160 in the sleep system. In this particular installation, the user begins by positioning flexible sheet end 160A on base 130 as shown. More particularly, the user installs flexible sheet end 160A adjacent the edge of base 130 such that flexible sheet 160 runs along base 130, over corner support bar 215, between bolts 502 and 504, up riser member 120 of support component 110 and over the top of riser member 120. The jagged line indicated at the top of FIG. 6 is the approximate location on flexible sheet 160 where the sleeve 150 of the flexible load-bearing member 105 attaches to the flexible sheet 160.

Figure 7:
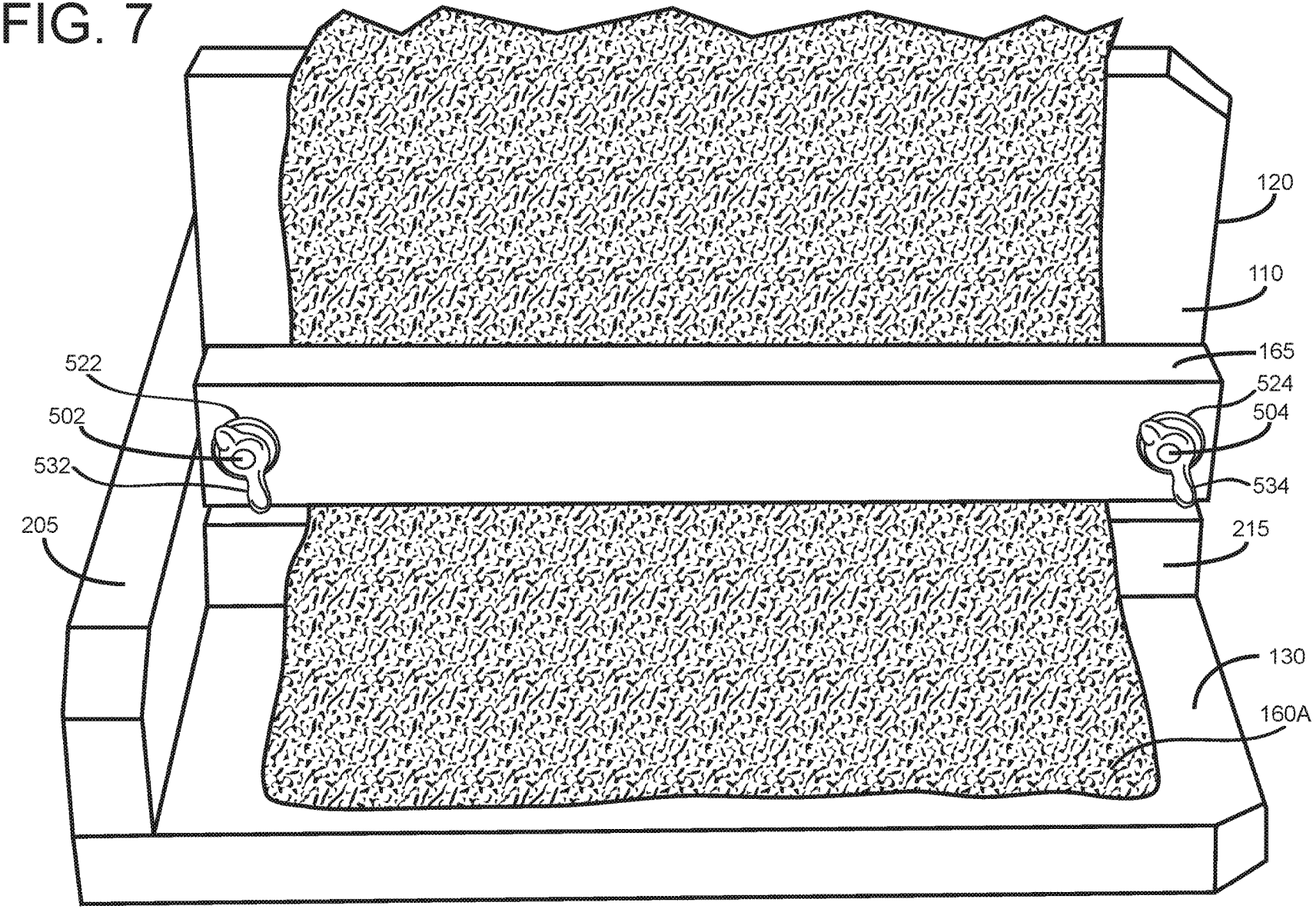
FIG. 7 is a left end perspective view of the riser member and base region of the disclosed sleep system after installation of a clamp bar to hold the flexible member and flexible load-bearing member therein.

To hold flexible sheet 160 to riser member 120, clamp 165 is positioned on riser member 120 as shown in FIG. 7. Clamp 165 includes two holes (not shown) that receive bolts 502 and 504, respectively. The ends of bolts 502 and 504 protrude out clamp 165 to receive respective washers 522 and 524. Washers 522 and 524 are placed over bolts 502 and 504, respectively. Wing nuts 532 and 534 are threaded on bolts 502 and 524, respectively. Next, wing nuts 532 and 534 are tightened to firmly anchor flexible sheet 160 on riser member 120 above corner support bar 215.

Figure 8B:
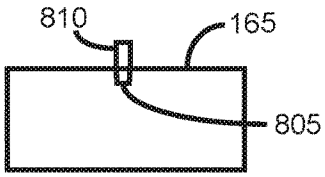
FIG. 8B is an end view of the clamp used to secure the flexible sheet to a riser member in the disclosed sleep system.
Figure 8C:
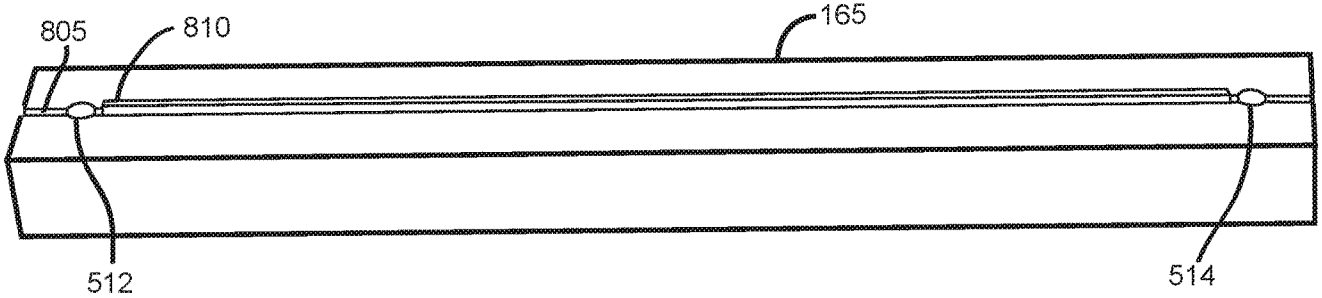
FIG. 8C is another perspective view of the clamp used to secure the flexible sheet to a riser member in the disclosed sleep system.
Figure 8A:
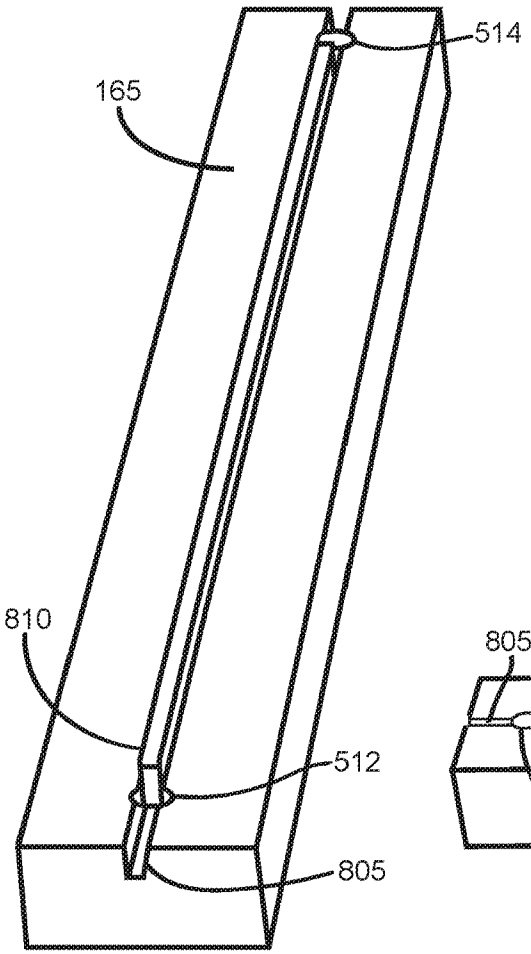
FIG. 8A is a top perspective view of the clamp used to secure the flexible sheet to a riser member in the disclosed sleep system.

FIGS. 8A, 8B and 8C show views of a representative clamp 165 that may also be employed for clamp 170. FIG. 8A is a top right perspective view of clamp 165. In this particular embodiment, clamp 165 exhibits a generally parallelepiped shape. Clamp 165 includes bolt-receiving holes 512 and 514. A retainment enhancing member 810 is situated in groove 805 and held in groove 805 by compression or glue in one embodiment. Retainment enhancing member 810 may be fabricated of rubber, neoprene, polyurethane, silicon, Viton elastomers or other flexible polymer that exhibits superior memory and exhibits a hardness less than approximately 50 of the Shore A scale. Such materials are suitable for contacting flexible sheet 160 to hold flexible sheet 160 in place on a riser member. (Viton is a registered trademark of The Chemours Company.) Retainment enhancing member 810 enables the clamp 165 to better grip flexible sheet 160 to prevent slippage of flexible sheet 160 in clamp 165.

When the user orients clamp 165 as shown in FIG. 7 and tightens wing nuts 532 and 534, retainment enhancing member 810 (not visible in FIG. 7) engages flexible sheet 160 and assists clamp 165 in holding flexible sheet 165 in place on the sleep system. FIG. 8B is an end plan view of clamp 165 including retainment enhancing member 810. FIG. 8C is view of clamp 165 and retainment enhancement mechanism 810 from another perspective. In an alternative embodiment, riser member 160 (shown in FIG. 5) may include a groove (not shown) between holes 512, 514 that is aligned with the retainment enhancement mechanism 810, to further enhance the ability of clamp 165 (shown in FIG. 7) to hold, i.e. anchor, flexible support sheet 160 in place on riser member 120. In this embodiment, the retainment enhancement mechanism aligns with the groove as clamp 165 is tightened by the user.

Figure 9:
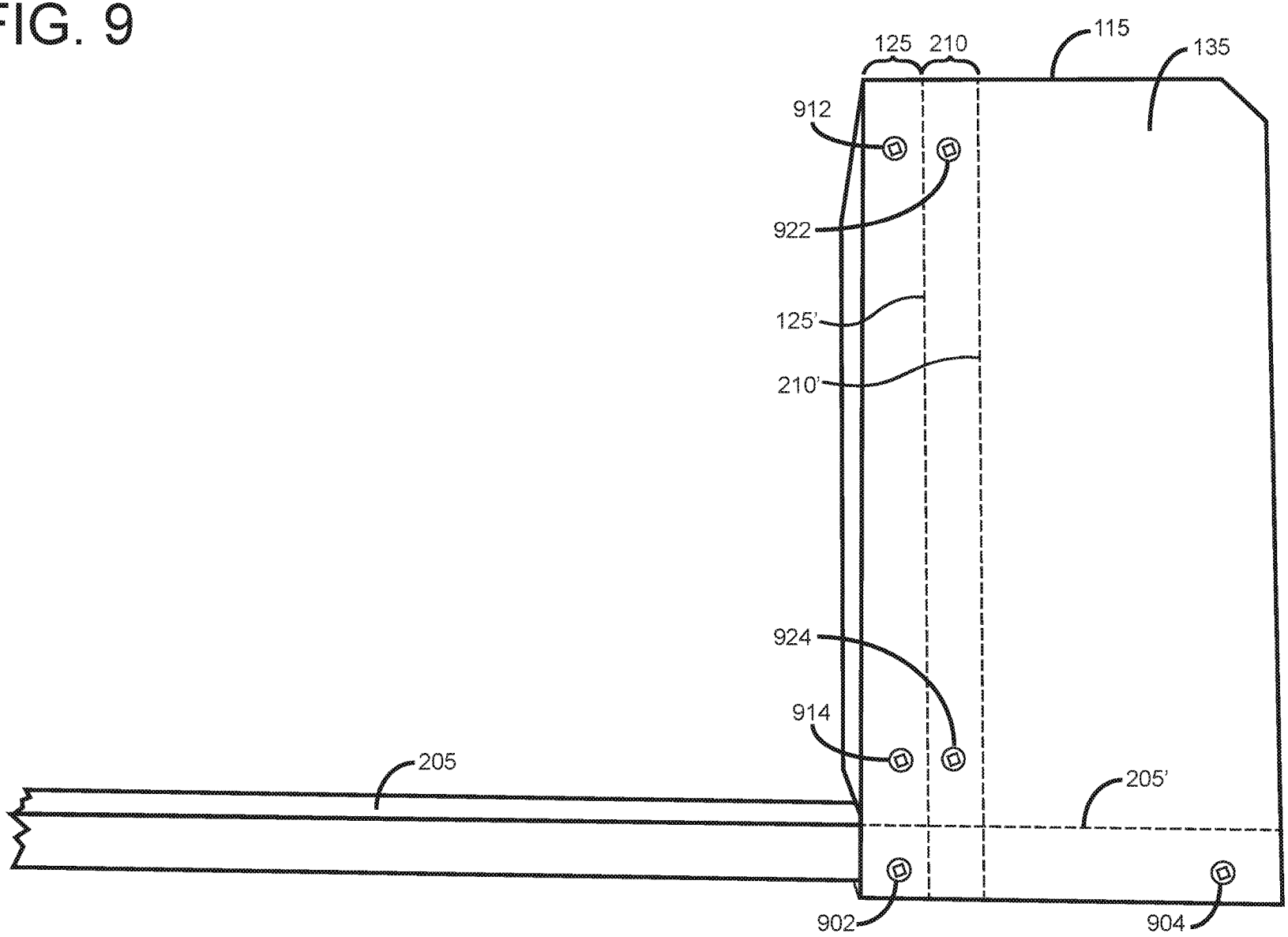
FIG. 9 is a bottom view of a portion of the disclosed sleep system showing screw placement to hold a support component together.

FIG. 9 shows the underside of support component 115 to demonstrate one way of mechanically coupling connective member 205, riser member 125, and corner support bar 210 to base 135. More particularly, screws 902 and 904 hold connective member 205 to base 135. Screws 912 and 914 hold riser member 125 to base 135. Screws 922 and 924 hold corner support bar 210 to base 135. In FIG. 9, a dashed line 205' represents the portion of connective member 205 that is obscured by base 135. Dashed lines 125' and 210' represent portions of riser members 125 and corner support bar 210, respectively, that are obscured by base 135.

Figure 10A:
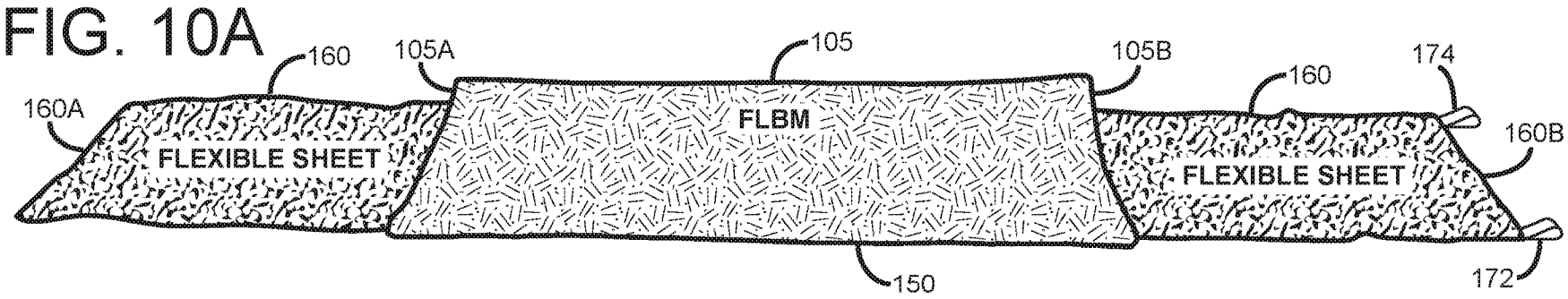
FIG. 10A is a top side perspective view of the flexible sheet with flexible load-bearing member thereon before installation in the disclosed sleep system.
Figure 10B:
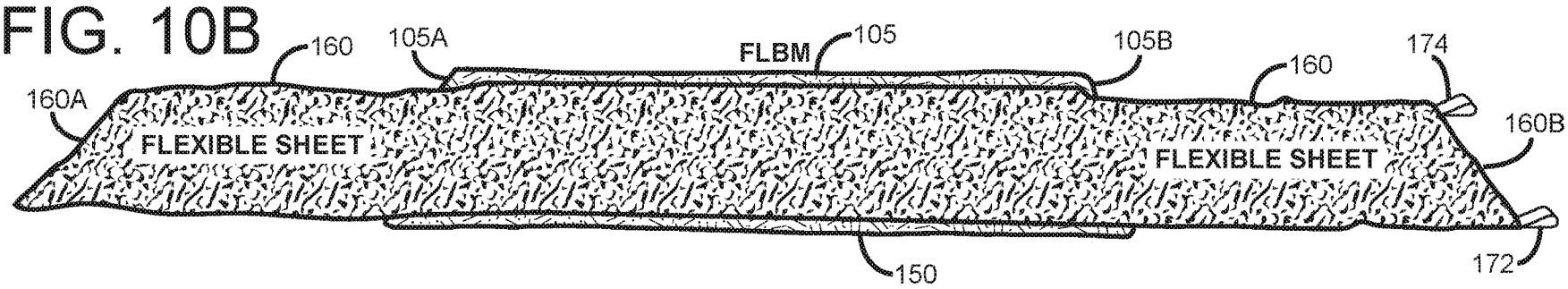
FIG. 10B is a bottom side perspective view of the flexible sheet with flexible load-bearing member attached thereto before installation in the disclosed sleep system.

FIG. 10A is a top perspective view of flexible load bearing member (FLBM) 105 and flexible sheet 160 shown prior to installation of cushion element 155 therein. FLBM 105 may include a flexible sleeve 160 that is permanently attached to flexible sheet 160 via stitching, adhesives or thermowelding. Alternatively, flexible sleeve 160 is removably attached to flexible sheet 160 via hook-and-loop fasteners (not shown) or other non-permanent technique. FIG. 10B shows the reverse side of the FLBM 105 and flexible sheet 160 of FIG. 10A. It is noted that in this embodiment, flexible sheet 160 extends from end 160A all the way across FLBM 105 to end 160B.

Figure 10C:
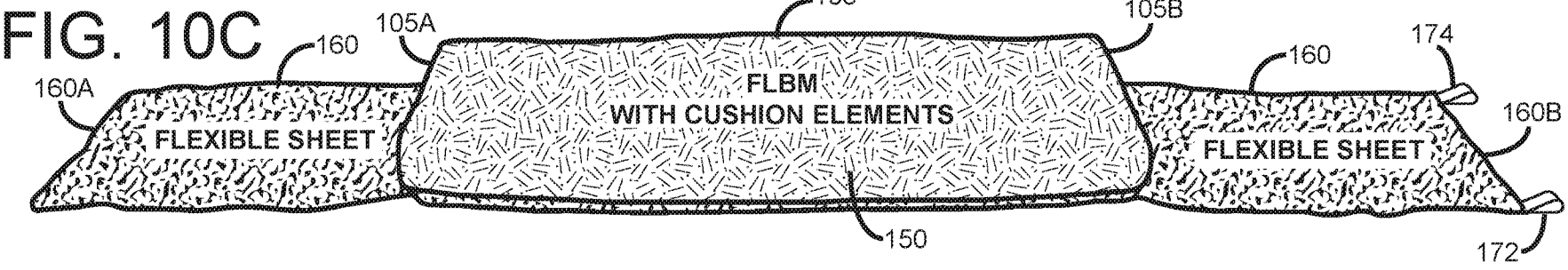
FIG. 10C is a top perspective view of the flexible sheet with flexible load-bearing member thereon shown after installation of at least one cushion element in the flexible load-bearing member.

FIG. 10C shows the flexible load bearing member (FLBM) 105 and flexible sheet 160 after installation of a cushion element in flexible load bearing member (FLBM) 105. The cushion element is situated in flexible sleeve 150 of FLBM 105. Flexible sheet 160 may be fabricated from fabric materials that are unaffected by changes in humidity, that contain fibers that resist stretching when subjected to load, and that contain fibers that exhibit good lateral flexibility when woven. For example, "utility" fabrics such as nylon, polyester and Kevlar (Kevlar is a trademark of DuPont) are examples of synthetic fabrics that are acceptable for use as flexible sheet 160. These are examples of web materials that may be employed as flexible sheet 160. It has been found that natural materials such as wool, cotton and silk do not provide optimal performance when used as flexible sheet 160. Flexible sheet 160 may also be fabricated from a solid membrane material such as Mylar (Mylar is a trademark of DuPont) plastic film material or polyester film plastic film material. These solid membrane materials are desirably unaffected by changes in humidity and are also resistant to stretching when subjected to load. These solid membrane materials also exhibit good lateral flexibility. In one embodiment, flexible sheet 160 should be flexible in every direction, except when stretched. When stretched, flexible sheet 160 should be flexible in the lateral direction (i.e. the direction between sheet ends 160A and 160B), but not flexible in the longitudinal direction.

The flexible material selected for flexible load-bearing member (FLBM) 150 should exhibit the following properties, namely to be unaffected by changes in humidity, to resist stretching when subjected to load, and to include fibers that exhibit good lateral flexibility when woven. Utility fabric materials (100 and 0046% synthetics) such as nylon, polyester and Kevlar produce acceptable results when employed as flexible sheet 160. Cloths woven from natural materials such as wool, cotton, and silk are less desirable.

Suitable materials for cushion element 155 include medium to firm materials such as expanded polyurethanes and non-woven polyester fibers. Cushion element 155 establishes as base minimum amount of cushioning, and as such should exhibit good memory and fast recovery.

It is very desirable that the material selected for flexible sheet 160 and sleeve 150 be washable because these components will be subject to perspiration, dirt and oils in the course of normal use. The cushion element may be removed from sleeve 150 of FLBM 105 prior to cleaning. With the cushion now removed from sleeve 150, the sleeve 150 and the flexible sheet 160 that it attached to the sleeve 150 may be laundered as a unitary item with a conventional washing machine.

Figure 10D:
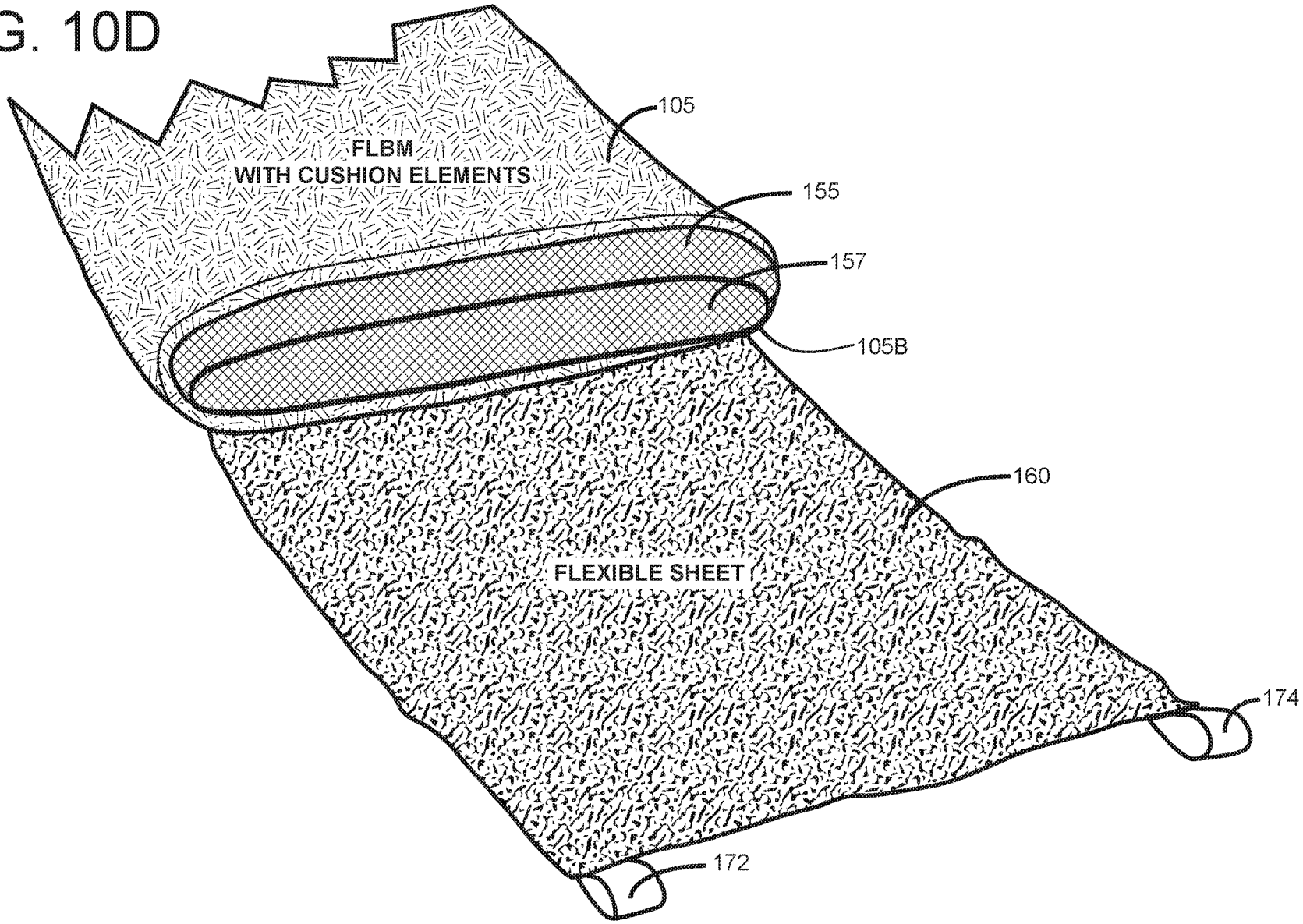
FIG. 10D is close-up perspective view of the flexible sheet with flexible load-bearing member thereon shown after installation of a multiple cushion elements in the flexible load-bearing member.

FIG. 10D is a close-up, right side, top perspective view of a portion of flexible load bearing member (FLBM) 105 and flexible sheet 160. In this particular embodiment, cushion elements 155 and 157 are situated in sleeve 150 of FLBM 105. One end of sleeve 150 is shown as being folded back to provide better visibility to see cushion elements 155 and 157 inside sleeve 150. In actual practice, this end of sleeve 150 need not be folded back, but rather may be fully extended to cover this end of sleeve 150.

Figure 10E:
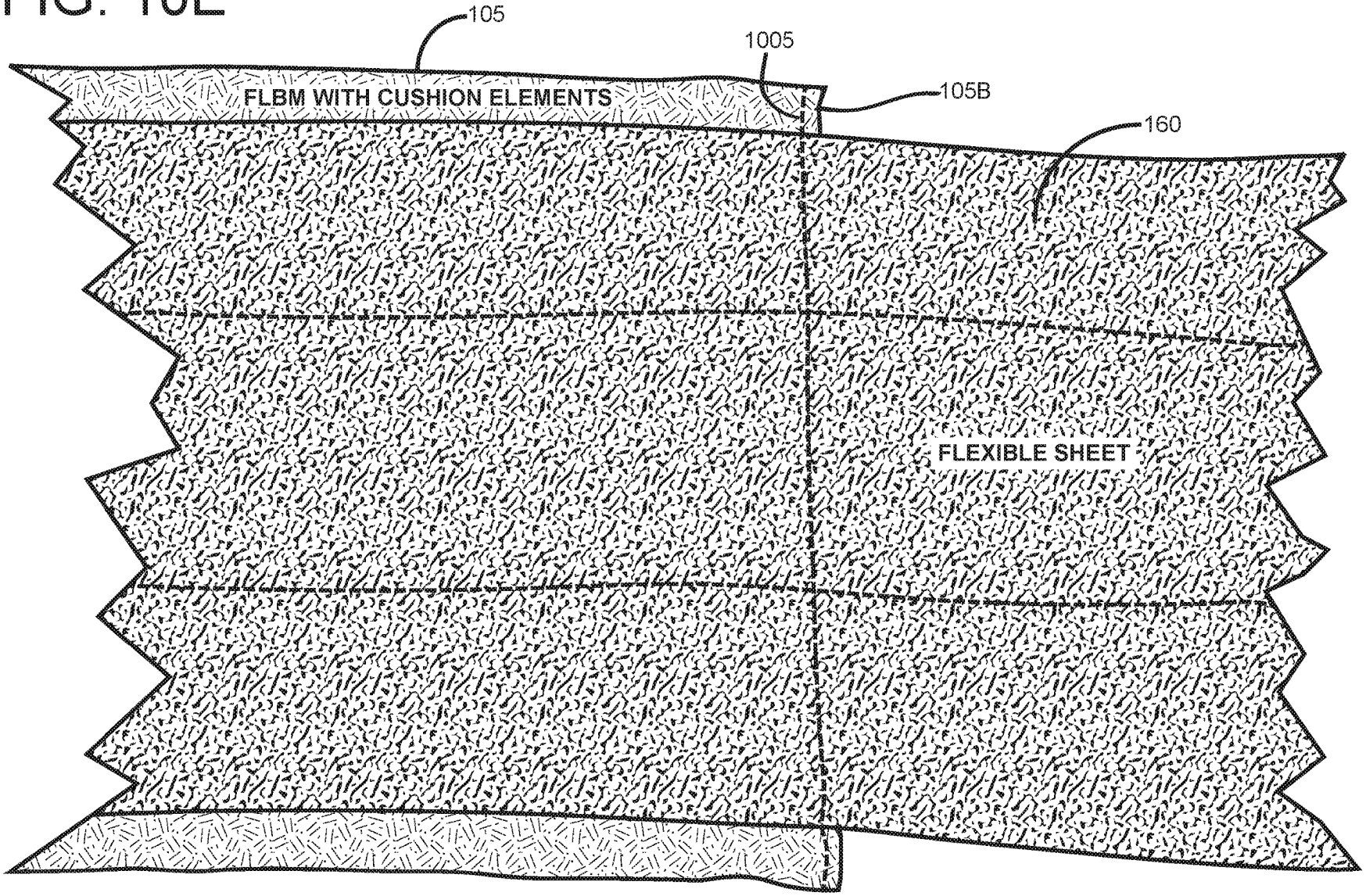
FIG. 10E is close-up bottom plan view of the flexible sheet with flexible load-bearing member thereon.

FIG. 10E is a close-up, right side, bottom plan view of the underside of the same end of flexible load bearing member (FLBM) 105 and flexible sheet 160 that FIG. 10D depicts. Flexible sheet 160 is visible running underneath FLBM 205. One of multiple stitch lines 1005 is depicted for attaching FLBM 105 such as sleeve 150 to flexible sheet 160.

Figure 10F:
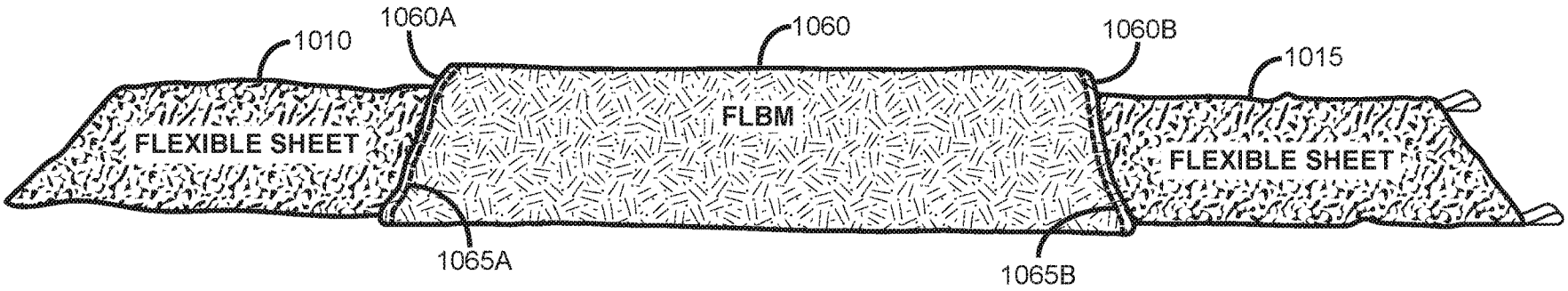
FIG. 10F is top perspective view of an alternative embodiment showing a respective flexible sheet attached to each of the two ends of the flexible load-bearing member.

FIG. 10F depicts a top, perspective view an alternative embodiment of the flexible load-bearing member (FLBM) and flexible sheet portion of the disclosed sleep system. In this embodiment, two different flexible sheets 1010 and 1015 are attached to the respective ends 1060A and 1060B of flexible load-bearing member (FLBM) 1060. Substantially the same FLBM used as FLBM 105 of FIG. 10A may be used as FLBM 1060. However, a continuous flexible sheet need not span the entire length of FLBM 1060 to provide support thereto. Instead, flexible sheets 1010 and 1015 attached to the ends 1060A and 1060B via stitch lines 1065A and 1065B that may be sewn on the bottom of FLBM 1060. Dashed lines are used to illustrate these stitch lines that may otherwise not be visible from the top of FLBM 1060. The same flexible sleeve 150 used in the embodiment of FIG. 10A may also employed in FLBM 1060 of FIG. 10F (not shown in this view.) The same cushion elements 155 and 157 used in the embodiment of FIG. 10D may also be used in a sleeve when employed on FLBM 1060.

Figure 10G:
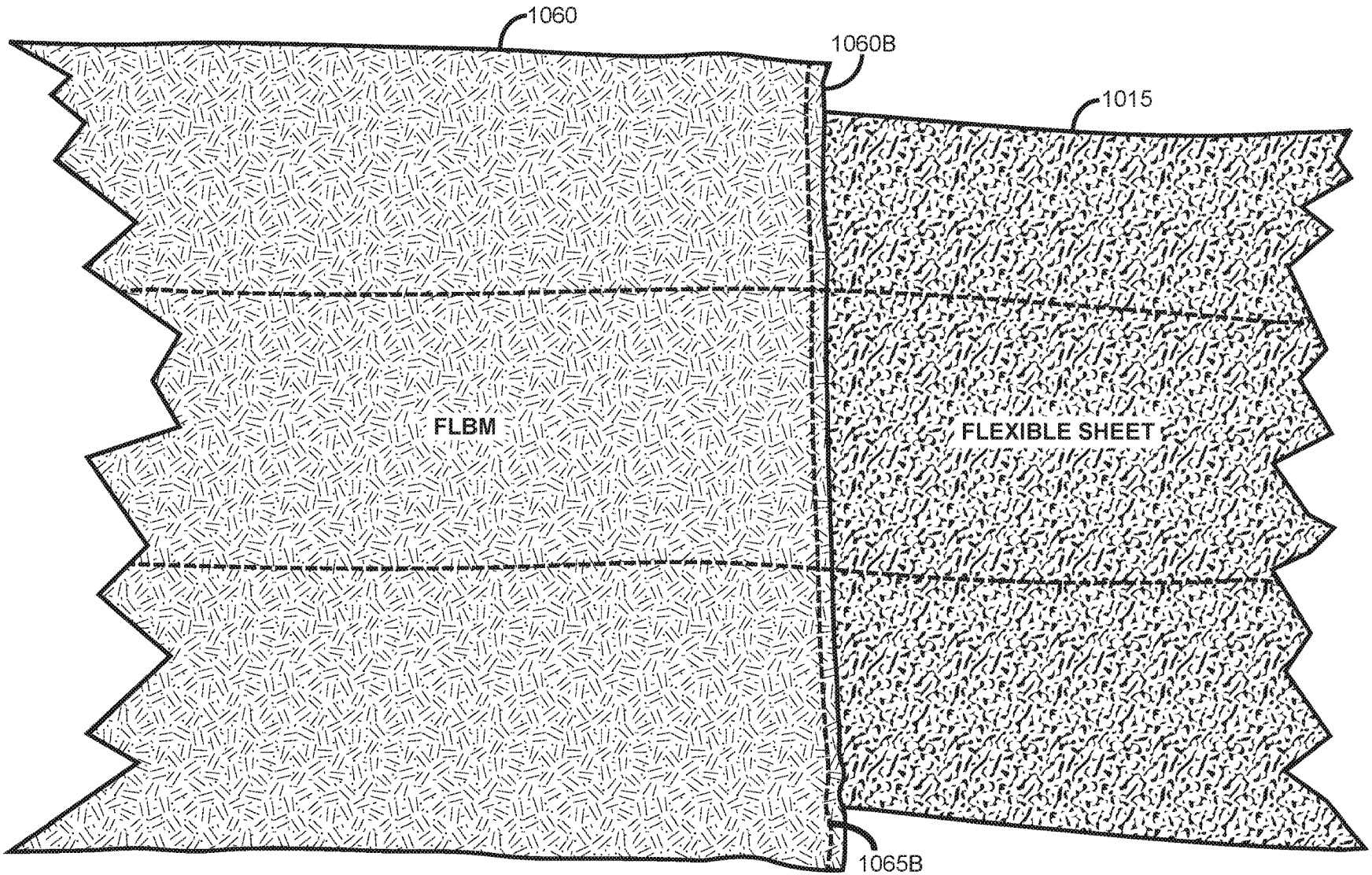
FIG. 10G is close-up bottom plan view of the alternative embodiment of FIG. 10F.

FIG. 10G is a bottom plan view of a portion of the embodiment shown in FIG. 10F. FIG. 10G shows stitch line 1065B that may be used to hold the end 1060B of FLBM 1060 to flexible sheet 1015. A flexible sleeve similar to flexible sleeve 150 may be employed on the opposite (top) side of FLBM 1060 to hold cushion elements therein.

Figure 11:
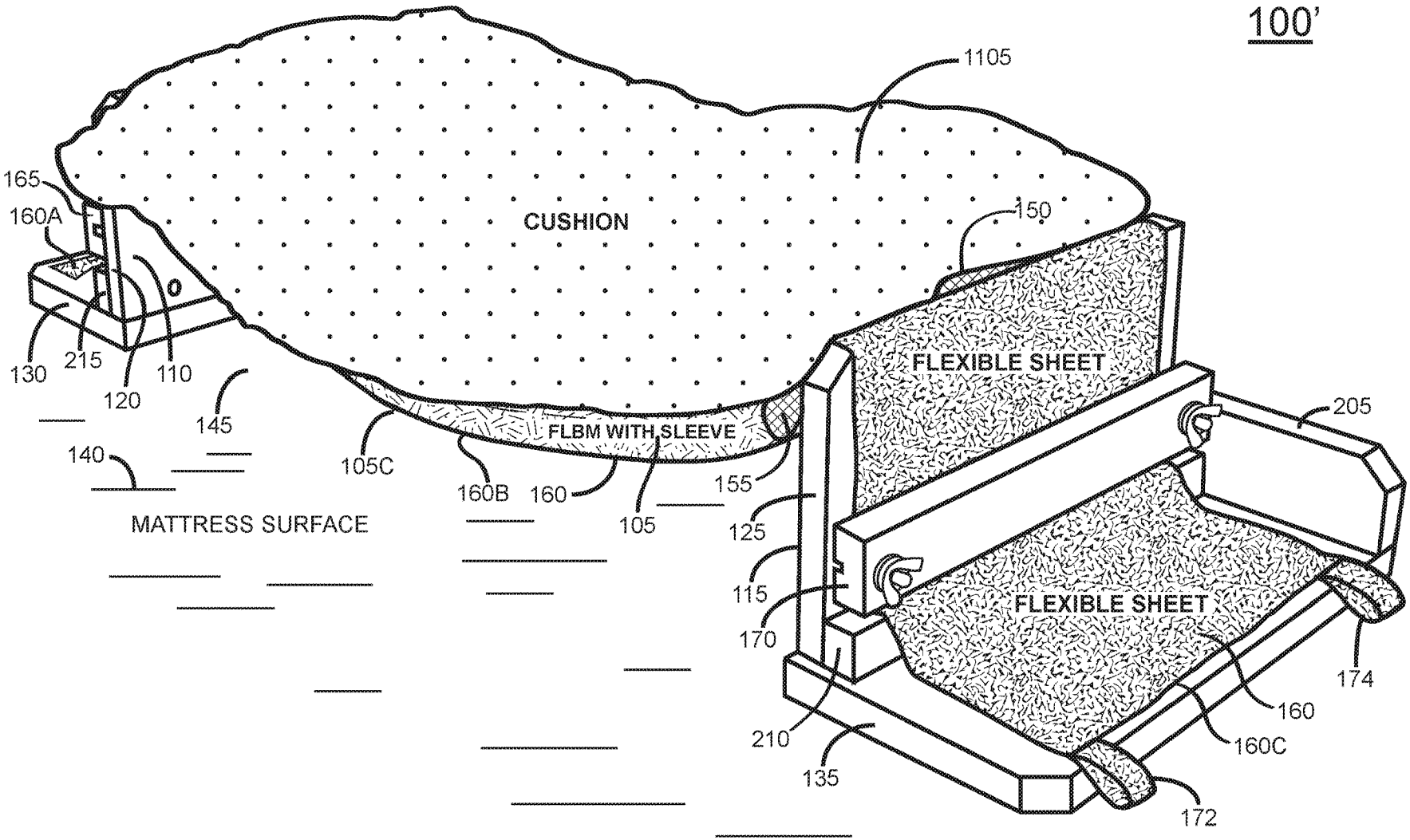
FIG. 11 is perspective view of the completed sleep system showing installation of a user-interface cushion on the flexible load bearing member that is situated between the riser members thereof.

FIG. 11 is a top right side perspective view of sleep system 100 of FIG. 1 with another cushion member 1105 situated atop flexible load-bearing member (FLBM) 105 to form sleep system 100'. Like numbers indicate like components when comparing the sleep system 100' of FIG. 11 with the sleep system 100 of FIG. 1. The sleep system may be used by the user without cushion member 1105. In that case, the user relies on the cushioning already provided by cushion elements 155 and 157 in flexible sleeve 150 on FLBM 105. However, for additional cushioning action, the user may opt to use cushion member 1105 atop FLBM 105 to form sleep system 100'. It is noted that since flexible load-bearing member (FLBM) 105 already provides substantial cushioning, cushion 1105 may exhibit a thickness significantly less than that of a conventional pillow and still be very comfortable to the user.

Figure 12:
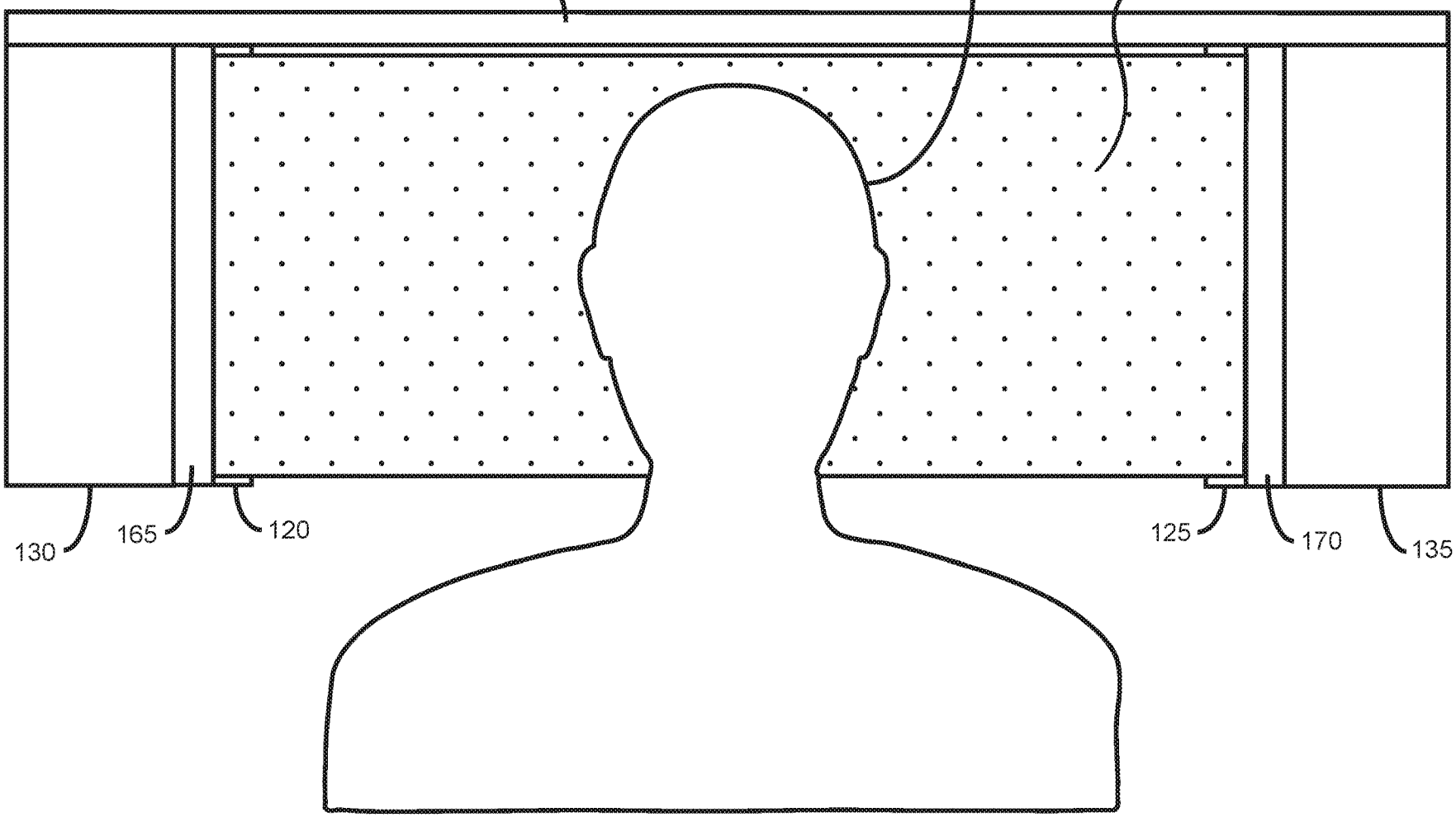
FIG. 12 is a top plan view of the disclosed sleep system showing a user with neck and head supported by the disclosed sleep system when the user is in the sleeping on back position while resting on the flexible load-bearing member without the user-interface cushion.
Figure 13:
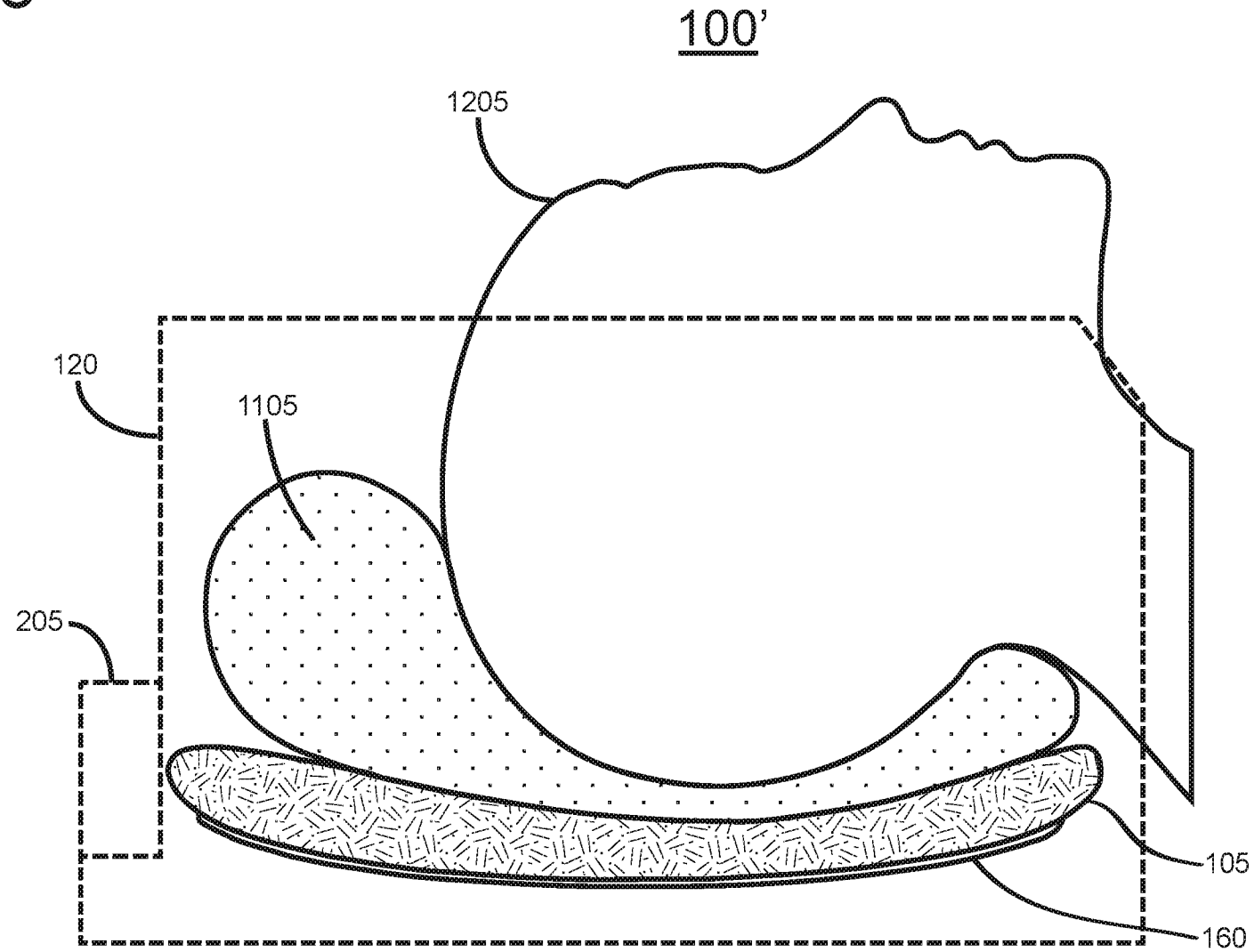
FIG. 13 is a side plan view of the disclosed sleep system of FIG. 12 showing a user with neck and head supported by the disclosed sleep system when the user is in the sleeping on back position.
Figure 14:
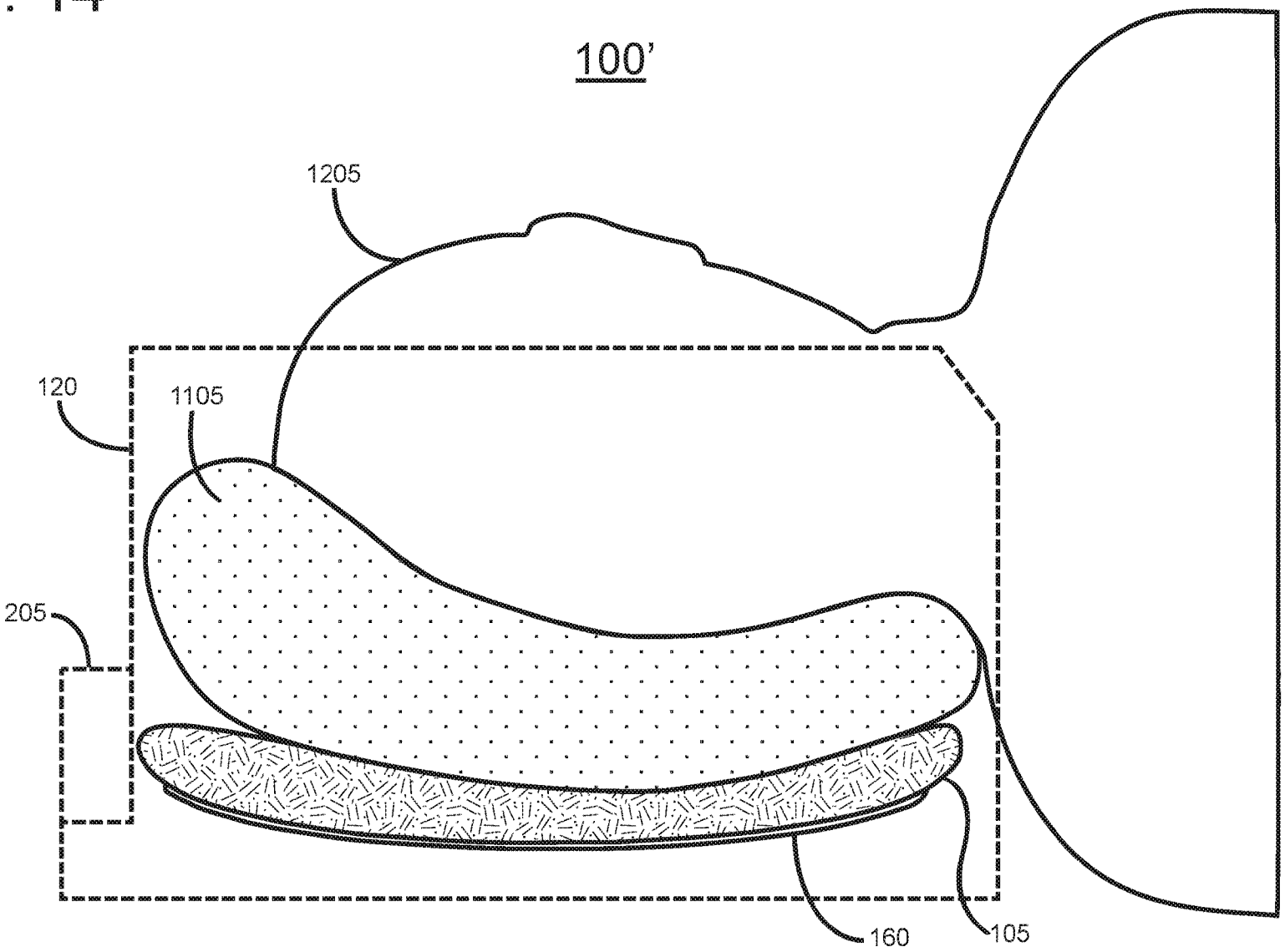
FIG. 14 is a side plan view of the disclosed sleep system of FIG. 12 showing a user with neck and head supported by the disclosed sleep system when the user is in the sleeping on side position.

FIG. 12 shows a simplified top plan view of a person 1205 sleeping on his or her back on sleep system 100', as viewed from above the sleep system. The head of person 1205 rests on cushion member 1105 at a height above the mattress (not shown) selected by the user making an appropriate adjustment to flexible sheet 160 held by clamps 165 and 170. Cushion member 1105 may also be referred to as a "user interface cushion". FIG. 13 is a simplified side view of the same person 1205 resting in sleep system 100'. While the solid lines of head 1205, cushion member 1105, flexible load bearing member (FLBM) 105 and flexible sheet 120 focus on these elements, dashed lines are used to represent riser member 120 and connective member 205 so that the solid line elements are not obscured in this view. FIG. 14 is a representation of person 1205 sleeping on his or her side on sleep system 100 at a height selected by the person. In FIGS. 13-14, the mattress (not shown) is immediately below the dashed line that represents riser member 120.

Figure 15:
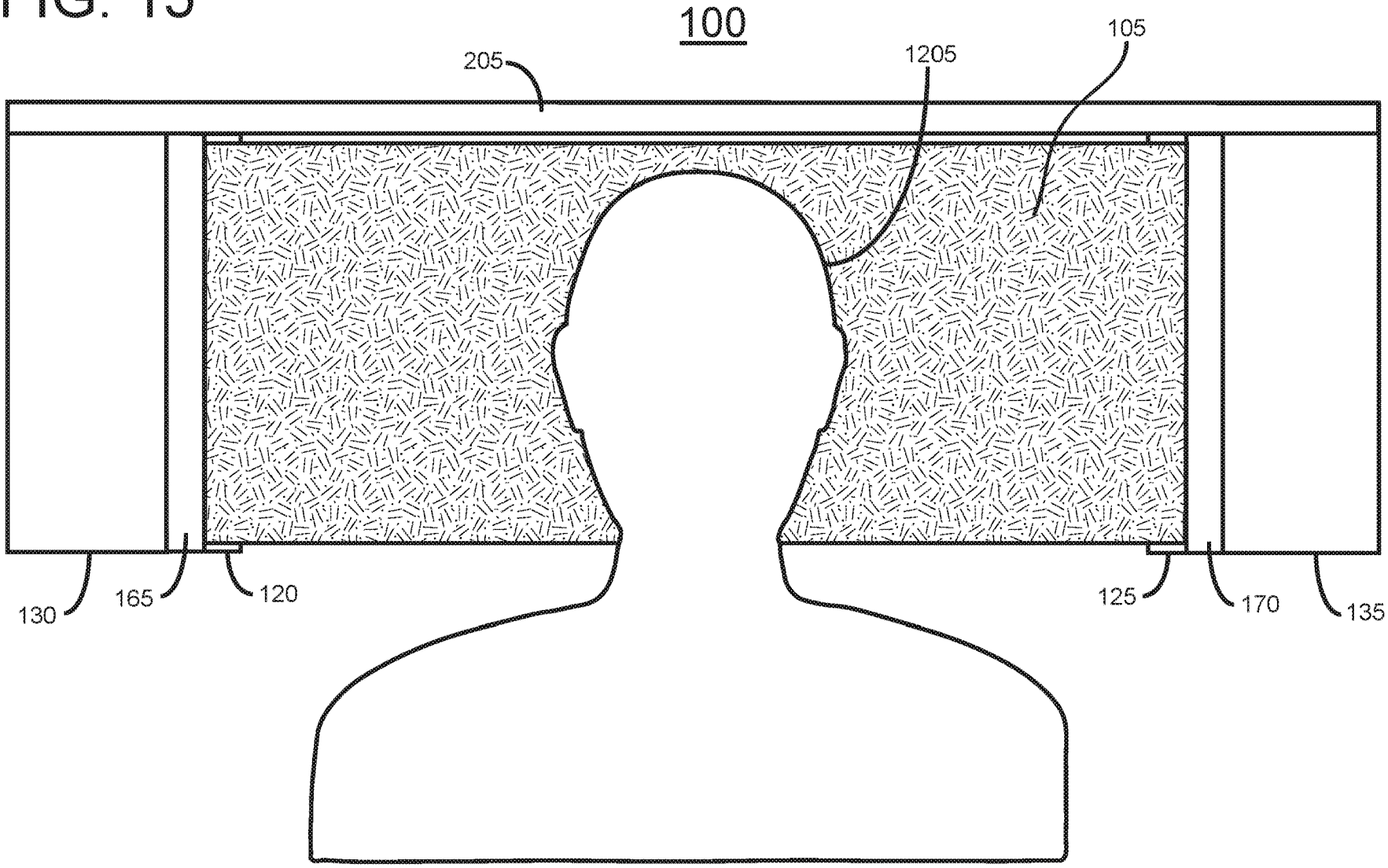
FIG. 15 is a top plan view of the disclosed sleep system showing a user with neck and head supported by the disclosed sleep system when the user is in the sleeping on back position while resting on the flexible load-bearing member with the user-interface cushion.

FIG. 15 shows person 1205 sleeping on the back with the person's head positioned directly on flexible load bearing member (FLBM) 105 without using the optional cushion member 1105. FLBM 105 itself provides cushioning by virtue of the cushion element or cushion elements inside thereof. Since cushion member 1105 is not present in this embodiment, the user may adjust the height of FLBM 105 higher than the scenario of FIGS. 12-14 where cushion member 1105 is employed as part of the sleep system. The height of FLBM 105 and cushion member 1105 is adjustable by the user loosening the wingnuts on clamp 170, pulling pull tabs 172 and 174 to raise the height of the FLBM 105 and retightening the wingnuts on clamp 176. This action increases the tension exhibited by FLBM 105. Alternatively, to lower FLBM 105 and decrease the tension on FLBM 105, the user may loosen 160 the wingnuts on clamp 170, advance a desired amount of flexible sheet into the region between riser members 120 and 125, and then retighten the wingnuts on clamp 170. The above disclosure describes a manual adjustment of the tension on flexible sheet 160. It is also contemplated that this tension be adjusted by an automatic mechanism in an alternative embodiment of the sleep system.

In one embodiment, the support components 110 and 115, the riser members 120 and 125, the bases 130 and 135, the corner support bars 210 and 215, connective member 205, the clamps 165 and 170 may all be formed from wood, plastic, metals or combinations of these materials. As described above, the listed elements are discrete structures. However, except for the clamps 165 and 170, the remaining components may be formed as a single structure by using molding methodology to fabricate the structure. More particularly, in one embodiment, support components 110, 115, and connective member 205 may be made from the same material and integrated together as one common structure. For example, support components 110, 115 and connective member 205 may be molded into a common structure by using a moldable material such as plastic. Plastics such as polyvinyl chloride (PVC) and acrylonitrile butadiene styrene (ABS) may be employed for this purpose. In this embodiment, support components 110, 115 and connective member 205 are made from the same material such that support components 110, 115 are rigidly held together by connective member 205 and form a common unitary integrated structure. Clamps 165, 170 may be molded, or otherwise formed, separately from the other parts of the sleep system. In one embodiment the parts of the sleep system, except for connective member 205, are made of one rigid material such as expanded rigid plastics like PVC and ABS, while connective member 205 is made of another rigid material such as aluminum, for example extruded aluminum. Such an aluminum connective member 205 provides rigidity to the overall sleep system structure by providing rigidity sufficient to prevent riser members 120, 125 of support components 110, 115 respectively from being pulled inward when the user places his or her head on the sleep system. Stainless steel fasteners may be employed to screw together the plastic parts of support component 110. Stainless steel fasteners may also be used to screw together the plastic parts of support component 115. Stainless steel fasteners may be employed to rigidly hold connective member 205 to both support components 110 and 115, thus providing a rigid sleep system that holds support components 110 and 115 in position when the user rests on the sleep system.

In the embodiments described above, the connective member 205 that connects the two support components 110 and 115 provides a fixed distance between the riser members 165 and 170. Another embodiment is contemplated wherein connective member 205 includes two connective member members that overlap and that can slide with respect to each other to adjust the distance between the two riser members. This provides another adjustment of the height of flexible sheet 160 and flexible load-bearing member 105 in addition to the height adjustment provided by clamps 165 and 170.

The following are representative dimensions of selected components of the sleep system. These dimensions are provided for purposes of example and should not be taken as being limiting. Both larger and smaller dimensions may be used depending on the particular application. In one embodiment, the length dimension of sleep system 100 of FIG. 1 may be 91.44 cm (36 inches). The depth of sleep system 100 may be 30.48 cm (12 inches) in one embodiment. The tops of risers 120 and 125 may be 13.97 cm (5.5 inches) above mattress 140 in one embodiment. The distance between risers 120 and 125 may be 60.69 cm (24 inches) in one embodiment. The width of flexible sheet 160 may be 25.4 cm (10 inches) in one embodiment. It is noted that two sleep systems with the above dimensions will fit on a king size bed, while a single sleep system will fit on a twin bed.

LIST OF REPRESENTATIVE COMPONENTS

Sleep System 100
Flexible load-bearing member 105 (FLBM 105)
  opposed ends 105A and 105B
  Front side 105C
  Rear Side 105D
Support components 110, 115
  Riser members 120, 125
  Bases 130, 135
  Corner support bar 210
  Corner support bar 215
Mattress surface 140
Open region 145—between mattress surface 140 and cushion member 105
Flexible Sleeve 150
Cushion elements 155, 157
Continuous flexible sheet 160 with opposed ends 160A, 160C
  Support section 160B
  Pull tabs 172, 174
Connective member 205
Corner support bars 210, 215
Screws or bolts 212, 214
clamps 165, 170 (clamp bars)
Bolts 502, 504
Holes 512, 514
Washers 522, 524
Wing nuts 532, 534
Groove 805
Retainment enhancing mechanism 810
Screws 902, 904
Screws 912, 914
Screws 922, 924
Stitch line 1005
Flexible sheet 1010
Flexible sheet 1015
Flexible Load-Bearing Member (FLBM) 1060
  ends 1060A, 1060B
Stitch lines 1065A, 1065B
Cushion member 1105
Person 1205

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A sleep system, comprising:

a first support component including a first substantially rectangular solid planar riser member attached to a first solid planar base, the first solid planar riser member being oriented substantially perpendicular to the first solid planar base;

a second support component including a second substantially rectangular solid planar riser member attached to a second solid planar base, the second solid planar riser member being oriented substantially perpendicular to the second solid planar base;

a rigid connective member positioned between the first and second support components to rigidly hold the first and second solid planar riser members at a predetermined distance apart from one another, such that the first and second support components and the connective member therebetween provide rigidity to the sleep system;

a flexible sheet extending between the first and second solid planar riser members;

a flexible load-bearing member, situated atop the flexible sheet and including first and second ends, wherein the flexible load-bearing member is provided support by the flexible sheet between the first and second solid planar riser members; and first and second adjustable tension clamps situated on the first and second solid planar riser members, respectively, to adjustably hold the flexible sheet between the first and second solid planar riser members to control the amount of tension and height exhibited by the flexible sheet.

2. The sleep system of claim 1, wherein the flexible sheet exhibits a shallow U-shaped geometry in a cross-section between the first and second riser members.

3. The sleep system of claim 1, wherein the flexible load-bearing member includes at least one cushion element.

4. The sleep system of claim 1, wherein the flexible load-bearing member includes a sleeve that receives at least one cushion element.

5. The sleep system of claim 1, further comprising a user-interface cushion situated atop the flexible load bearing member.

6. The sleep system of claim 1, wherein the first and second adjustable tension clamps hold the flexible sheet to the first and second riser members at a height selectable by a user.

7. The sleep system of claim 1, wherein the flexible sheet is fabricated from a web material.

8. The sleep system of claim 1, wherein the flexible sheet is fabricated from a thin film material.

9. The sleep system of claim 1, wherein the sleep system forms an open region below the bottom of the flexible sheet.

10. The sleep system of claim 1, wherein the flexible sheet includes at least one pull-tab to assist a user in pulling the flexible sheet to engage with at least one of the first and second adjustable tension clamps.

11. A sleep system, comprising:

a first support component including a first substantially rectangular solid planar riser member attached to a first solid planar base, the first solid planar riser member being oriented substantially perpendicular to the first solid planar base;

a second support component including a second substantially rectangular solid planar riser member attached to a second solid planar base, the second solid planar riser member being oriented substantially perpendicular to the second solid planar base;

a rigid connective member positioned between the first and second support components to rigidly hold the first and second solid planar riser members at a predetermined distance apart from one another, such that the first and second support components and the connective member therebetween provide rigidity to the sleep system;

a flexible load-bearing member, situated between the first and second solid planar riser members, the flexible load-bearing member including first and second ends;

a first flexible sheet attached to the first end of the flexible load-bearing member;

a second flexible sheet attached to the second end of the flexible load-bearing member; and first and second adjustable tension clamps situated on the first and second solid planar riser members, respectively, to adjustably hold the first flexible sheet to the first solid planar riser member and to adjustably hold the second flexible sheet to the second solid planer riser member to control the amount of tension and height exhibited by the flexible load-bearing member therebetween.

12. The sleep system of claim 11, wherein the flexible sheet exhibits a shallow U-shaped geometry in a cross-section between the first and second riser members.

13. The sleep system of claim 11, wherein the flexible load-bearing member includes at least one cushion element.

14. The sleep system of claim 11, wherein the flexible load-bearing member includes a sleeve that receives at least one cushion element.

15. The sleep system of claim 11, further comprising a user-interface cushion situated atop the flexible load bearing member.

16. The sleep system of claim 11, wherein the first and second adjustable tension clamps that respectively hold the first and second flexible sheets to the first and second riser members provide the flexible load-bearing member with a height selectable by a user.

17. The sleep system of claim 11, wherein the flexible sheet is fabricated from a web material.

18. The sleep system of claim 11, wherein the flexible sheet is fabricated from a thin film material.

19. The sleep system of claim 11, wherein the sleep system forms an open region below the bottom of the flexible sheet.

20. The sleep system of claim 11, wherein at least one of the first and second flexible sheets includes a pull-tab to assist a user in pulling the at least one of the first and second flexible sheets.

21. A sleep system, comprising:

a first support component (110) including a first substantially rectangular solid planar riser member (120) attached to a first solid planar base (130), the first solid planar riser member (120) being oriented substantially perpendicular to the first solid planar base (130);

a second support component (115) including a second substantially rectangular solid planar riser member (125) attached to a second base (135), the second solid planar riser member (125) being oriented substantially perpendicular to the second solid planar base (135);

a rigid connective member (205) positioned between the first and second support components (110, 115) to rigidly hold the first and second solid planar riser members (120, 125) at a predetermined distance apart from one another;

a continuous flexible sheet (160) extending between the first and second solid planar riser members (120, 125);

a flexible load-bearing member (105), situated atop the continuous flexible sheet (160) and including first and second ends (105A, 105B), wherein the flexible load-bearing member (105) is provided support by the continuous flexible sheet (160) between the first and second solid planar riser members (120, 125);

a first corner support bar (215) situated adjacent a corner of the first support component (110) where the first planar base (130) and the first solid planar riser member (120) meet;

a second corner support bar (210) situated adjacent a corner of the second support component where the second solid planar base and the second solid planar riser member meet;

the flexible load bearing member (105) including a flexible sleeve (150) situated atop continuous flexible sheet (160); and a cushion element (155) situated within the sleeve 150;

wherein continuous flexible sheet (160) extends beyond a top of first solid planar riser member (120) vertically downward where it is engaged by a first lateral tension adjustment clamp (165) to adjustably hold flexible sheet (160) to first solid planar riser member (120), the first lateral tension adjustment clamp (165) including a first surface facing the first solid planar riser member (120), the first lateral tension adjustment clamp (165) extending horizontally across the first solid planar riser member (120) to hold the entire width of the flexible sheet (160) between the first surface of the first lateral tension adjustment clamp and the first solid planar riser member (120);

wherein continuous flexible sheet (160) extends beyond a top of second solid planar riser member (125) vertically downward where it is engaged by a second lateral tension adjustment clamp (170) to adjustably hold flexible sheet 160 to second solid planar riser member (125), the second lateral tension adjustment clamp (170) including a second surface facing the second solid planar riser member (125), the second lateral adjustment clamp (170) extending horizontally across the second solid planar riser member (125) to hold the entire width of the flexible sheet (160) between the second surface of the second lateral tension adjustment clamp (170) and the second solid planar riser member (120);

the first lateral tension adjustment clamp (165) including a first retainment enhancing member (810), a portion of the first retainment enhancing member (810) being situated in a first groove (805) of the first lateral tension adjustment clamp (165); and the second lateral tension adjustment clamp (170) including a second retainment enhancing member, a portion of the second retainment enhancing member being situated in a second groove of the second lateral tension adjustment clamp (170).

22. A sleep system, comprising:

a first support component (110) including a first substantially rectangular solid planar riser member (120) attached to a first solid planar base (130), the first solid planar riser member (120) being oriented substantially perpendicular to the first solid planar base (130);

a second support component (115) including a second substantially rectangular solid planar riser member (125) attached to a second base (135), the second solid planar riser member (125) being oriented substantially perpendicular to the second solid planar base (135);

a first corner support bar (215) situated adjacent a corner of the first support component (110) where the first planar base (130) and the first solid planar riser member (120) meet;

a second corner support bar (210) situated adjacent a corner of the second support component where the second solid planar base and the second solid planar riser member meet;

a rigid connective member (205) positioned between the first and second support components (110, 115) to rigidly hold the first and second solid planar riser members (120, 125) at a predetermined distance apart from one another;

a flexible load-bearing member (1060) including first and second ends (1060A, 1060B), the flexible load-bearing member (1060) being situated between the first and second solid planar riser members (120, 125), the flexible load bearing member (105) including a flexible sleeve (150), a cushion element (155) being situated within the sleeve 150;

a first flexible sheet (1010) attached to the first end (1060A) of the flexible load-bearing member (1060);

a second flexible sheet (1015) attached to the second end (1060B) of the flexible load-bearing member (1060);

wherein the first flexible sheet (1010) extends from the first end (1060A) positioned adjacent a top of the first solid planar riser member (120) vertically downward where it is engaged by a first lateral tension adjustment clamp (165) to adjustably hold first flexible sheet (1010) to first solid planar riser member (120), the first lateral tension adjustment clamp (165) including a first surface facing the first solid planar riser member (120), the first lateral tension adjustment clamp (165) extending horizontally across the first solid planar riser member (120) to hold the entire width of the first flexible sheet (1010) between the first surface of the first lateral tension adjustment clamp (165) and the first solid planar riser member (120);

wherein the second flexible sheet (1015) extends from the second end (1060B) positioned adjacent a top of the second solid planar riser member (125) vertically downward where it is engaged by a second lateral tension adjustment clamp (170) to adjustably hold second flexible sheet (1015) to second solid planar riser member (125), the second lateral tension adjustment clamp (170) including a second surface facing the second solid planar riser member (125), the second lateral tension adjustment clamp (170) extending horizontally across the second solid planar riser member (125) to hold the entire width of the second flexible sheet (1015) between the second surface of the second lateral tension adjustment clamp (170) and the second solid planar riser member (125);

the first lateral tension adjustment clamp (165) including a first retainment enhancing member (810), a portion of the first retainment enhancing member (810) being situated in a first groove (805) of the first lateral tension adjustment clamp (165); and the second lateral tension adjustment clamp (170) including a second retainment enhancing member, a portion of the second retainment enhancing member being situated in a second groove of the second lateral tension adjustment clamp (170), wherein the first and second lateral tension clamps (165 and 170) respectively hold first and second flexible sheets (1010 and 1015) to the first and second solid planar riser members (120 and 125) respectively to place flexible load-bearing member (1060) under tension at an adjustable height;

the first lateral tension adjustment clamp (165) including a first retainment enhancing member (810), a portion of the first retainment enhancing member (810) being situated in a first groove (805) of the first lateral tension adjustment clamp (165); and the second lateral tension adjustment clamp (170) including a second retainment enhancing member, a portion of the second retainment enhancing member being situated in a second groove of the second lateral tension adjustment clamp (170).

* * * * *